US012006562B2

(12) United States Patent
Yokoyama et al.

(10) Patent No.: US 12,006,562 B2
(45) Date of Patent: Jun. 11, 2024

(54) HOT DIP GALVANIZED STEEL SHEET AND METHOD FOR PRODUCING SAME

(71) Applicant: NIPPON STEEL CORPORATION, Tokyo (JP)

(72) Inventors: Takafumi Yokoyama, Tokyo (JP); Hiroyuki Kawata, Tokyo (JP); Kunio Hayashi, Tokyo (JP); Yuji Yamaguchi, Tokyo (JP); Satoshi Uchida, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 505 days.

(21) Appl. No.: 17/425,234

(22) PCT Filed: Feb. 6, 2020

(86) PCT No.: PCT/JP2020/004628
§ 371 (c)(1),
(2) Date: Jul. 22, 2021

(87) PCT Pub. No.: WO2020/162556
PCT Pub. Date: Aug. 13, 2020

(65) Prior Publication Data

US 2022/0090248 A1 Mar. 24, 2022

(30) Foreign Application Priority Data

Feb. 6, 2019 (JP) ..... 2019-019956

(51) Int. Cl.

| | |
|---|---|
| ***C21D 9/46*** | (2006.01) |
| ***C21D 1/25*** | (2006.01) |
| ***C21D 1/26*** | (2006.01) |
| ***C21D 1/76*** | (2006.01) |
| ***C21D 8/00*** | (2006.01) |
| ***C21D 8/02*** | (2006.01) |
| ***C21D 8/04*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/58*** | (2006.01) |
| ***C23C 2/02*** | (2006.01) |
| ***C23C 2/28*** | (2006.01) |
| ***C23C 2/40*** | (2006.01) |

(52) U.S. Cl.

CPC ..... *C22C 38/58* (2013.01); *C21D 1/25* (2013.01); *C21D 1/26* (2013.01); *C21D 1/76* (2013.01); *C21D 8/005* (2013.01); *C21D 8/021* (2013.01); *C21D 8/0226* (2013.01); *C21D 8/0236* (2013.01); *C21D 8/0436* (2013.01); *C21D 9/46* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C23C 2/02* (2013.01); *C23C 2/0224* (2022.08); *C23C 2/024* (2022.08); *C23C 2/28* (2013.01); *C23C 2/29* (2022.08); *C23C 2/40* (2013.01); *C21D 2211/001* (2013.01); *C21D 2211/003* (2013.01); *C21D 2211/005* (2013.01); *C21D 2211/008* (2013.01); *C21D 2211/009* (2013.01)

(58) Field of Classification Search

CPC ..... C21D 9/46; C22C 38/02; C22C 38/04; C22C 38/06

See application file for complete search history.

(56) References Cited

U.S. PATENT DOCUMENTS

2008/0000555 A1 1/2008 Nonaka et al.
2011/0162762 A1 7/2011 Matsuda et al.
(Continued)

FOREIGN PATENT DOCUMENTS

CN 102149841 A 8/2011
CN 107636184 A 1/2018
(Continued)

OTHER PUBLICATIONS

English machine translation of JP 2017-048412 A of Hayashi (Year: 2017).*

*Primary Examiner* — Jophy S. Koshy
(74) *Attorney, Agent, or Firm* — Birch, Stewart, Kolasch & Birch, LLP

(57) ABSTRACT

Provided are a hot dip galvanized steel sheet comprising a base steel sheet wherein the base steel sheet has a predetermined composition and contains ferrite: 0% to 50%, retained austenite: 0% to 30%, tempered martensite: 5% or more, fresh martensite: 0% to 10%, and pearlite and cementite in total: 0% to 5%, remaining structures consist of bainite, when defining a region having a hardness of 90% or less of the hardness at a position of ¼ thickness to the base steel sheet side from an interface of the base steel sheet and a hot dip galvanized layer as a "soft layer", there is a soft layer having a thickness of 10 μm or more at the base steel sheet side from the interface, the soft layer contains tempered martensite, and an increase rate in a thickness direction of an area % of tempered martensite from the interface to the inside of the base steel sheet inside the soft layer is 5.0%/μm or less, and a method for producing the same.

3 Claims, 2 Drawing Sheets

(56) References Cited

U.S. PATENT DOCUMENTS

| | | | | |
|---|---|---|---|---|
| 2013/0133786 | A1 | 6/2013 | Matsuda et al. | |
| 2014/0242416 | A1 | 8/2014 | Matsuda et al. | |
| 2014/0377582 | A1* | 12/2014 | Azuma ..... | C25D 7/0614<br>148/331 |
| 2015/0044502 | A1 | 2/2015 | Nakaya et al. | |
| 2015/0203947 | A1 | 7/2015 | Hasegawa et al. | |
| 2017/0107591 | A1 | 4/2017 | Takashima et al. | |
| 2018/0002800 | A1 | 1/2018 | Hasegawa et al. | |
| 2018/0030564 | A1 | 2/2018 | Hasegawa et al. | |
| 2018/0105908 | A1 | 4/2018 | Hayashi et al. | |
| 2018/0298462 | A1 | 10/2018 | Sano et al. | |
| 2019/0330721 | A1 | 10/2019 | Hayashi et al. | |

FOREIGN PATENT DOCUMENTS

| | | | |
|---|---|---|---|
| JP | 5-195149 | A | 8/1993 |
| JP | 10-130782 | A | 5/1998 |
| JP | 2006-104532 | A | 4/2006 |
| JP | 2011-184757 | A | 9/2011 |
| JP | 2013-144830 | A | 7/2013 |
| JP | 2017-48412 | A | 3/2017 |
| JP | 2017-53001 | A | 3/2017 |
| WO | WO 2013/051238 | A1 | 4/2013 |
| WO | WO 2014/020640 | A1 | 2/2014 |
| WO | WO 2015/151427 | A1 | 10/2015 |
| WO | WO 2016/113788 | A1 | 7/2016 |
| WO | WO 2016/113789 | A1 | 7/2016 |
| WO | WO 2018/055695 | A1 | 3/2018 |
| WO | WO 2016/171237 | A1 | 10/2018 |

* cited by examiner

HOT DIP GALVANIZED STEEL SHEET AND METHOD FOR PRODUCING SAME

FIELD

The present invention relates to a hot dip galvanized steel sheet and a method for producing the same, mainly relates to a high strength hot dip galvanized steel sheet to be worked into various shapes by press forming etc., as a steel sheet for automobile use and a method for producing the same.

BACKGROUND

In recent years, improvement of the fuel efficiency of automobiles has been sought from the viewpoint of control of hot house gas emissions accompanying the campaign against global warming. Application of high strength steel sheet for lightening the weight of car bodies and securing collision safety has been increasingly expanding. In particular, recently, the need for ultrahigh strength steel sheet with a tensile strength of 980 MPa or more has been increasingly rising. Further, high strength hot dip galvanized steel sheet which is hot dip galvanized on its surface is being sought for portions in car bodies where rust prevention is demanded.

Hot dip galvanized steel sheet used for auto parts requires not only strength, but also press formability, weldability, and various other types of workability necessary for forming parts. Specifically, from the viewpoint of press formability, excellent elongation (total elongation in tensile test: El), stretch flangeability (hole expansion rate: λ), and bendability are required from steel sheet.

In general, press formability deteriorates along with the higher strength of steel sheet. As means for achieving both higher strength and press formability of steel, TRIP (transformation induced plasticity) steel sheet utilizing transformation induced plasticity of retained austenite is known.

PTLs 1 to 3 disclose art relating to high strength TRIP steel sheet controlled in fractions of structural constituents to predetermined ranges and improved in elongation and hole expansion rates.

Furthermore, TRIP type high strength hot dip galvanized steel sheet is disclosed in several literature.

Normally, to produce hot dip galvanized steel sheet in a continuous annealing furnace, it is necessary to heat the steel sheet to the reverse transformation temperature region (>Ac1) and soak it, then in the middle of the process for cooling down to room temperature, dip it in a 460° C. or so hot dip galvanizing bath. Alternatively, after heating and soaking, then cooling down to room temperature, it is necessary to again heat the steel sheet to the hot dip galvanizing bath temperature and dip it in the bath. Furthermore, usually, to produce hot dip galvannealed steel sheet, it is necessary to perform alloying treatment after dipping the steel sheet in the coating bath, then reheat the steel sheet to a 460° C. or more temperature region. For example, PTL 4 describes that the steel sheet is heated to Ac1 or more, is then rapidly cooled down to the martensite transformation start temperature (Ms) or less, is then reheated to the bainite transformation temperature region and held at the temperature region to stabilize the austenite (austemper it), and is then reheated to the coating bath temperature or alloying treatment temperature for galvannealing. However, with such a production method, since the martensite and bainite is excessively tempered in the coating and alloying step, there was the problem that the material quality became poor.

PTLs 5 to 9 disclose a method for producing hot dip galvanized steel sheet comprising cooling the steel sheet after coating and alloying treatment, then reheating it to temper the martensite.

As art for improving the bendability of high strength steel sheet, for example, PTL 10 describes high strength cold rolled steel sheet with a surface layer part comprised of mainly ferrite produced by treating steel sheet to decarburize it. Further, PTL 11 describes ultra high strength cold rolled steel sheet having a soft layer at its surface layer part produced by decarburizing annealing steel sheet.

CITATIONS LIST

Patent Literature

[PTL 1] WO 2013/051238

[PTL 2] Japanese Unexamined Patent Publication No. 2006-104532

[PTL 3] Japanese Unexamined Patent Publication No. 2011-184757

[PTL 4] WO 2014/020640

[PTL 5] Japanese Unexamined Patent Publication No. 2013-144830

[PTL 6] WO 2016/113789

[PTL 7] WO 2016/113788

[PTL 8] WO 2016/171237

[PTL 9] Japanese Unexamined Patent Publication No. 2017-48412

[PTL 10] Japanese Unexamined Patent Publication No. 10-130782

[PTL 11] Japanese Unexamined Patent Publication No. 5-195149

SUMMARY

Technical Problem

However, if softening the surface layer of steel sheet in the above way so as to improve the bendability of the steel sheet, depending on the mode of deformation of the member at the time of deformation upon collision, there is a possibility of the bending deformation load of the member falling from the deformation load inherently expected from the strength of the steel sheet (i.e., the deformation load in the case where the surface layer of the steel sheet has not been softened). In general, if steel sheet receives bending deformation, the plastic strain generated will become larger the further toward the surface of the steel sheet. That is, the degree of contribution to the deformation load is greater in strength at the surface of the steel sheet than the inside of the steel sheet. Therefore, if the deformation of the member at the time of collision deformation becomes bending deformation, there is a possibility of the deformation load of the member falling due to the softening of the surface of the steel sheet.

The present invention was made in consideration of the above background. An object of the present invention is to provide hot dip galvanized steel sheet excellent in press formability and suppressed in drop in load at the time of bending deformation and a method for producing the same.

Solution to Problem

The inventors engaged in intensive studies for solving this problem and as a result obtained the following findings:

(i) In the continuous hot dip galvanization heat treatment step, martensite is formed by cooling down to the Ms or less after coating or coating and alloying. Further, after that, the steel may be reheated and held isothermally to suitably temper the martensite and, in the case of steel sheet containing retained austenite, further stabilize the retained austenite. By such heat treatment, the martensite is no longer excessively tempered by the coating or coating and alloying, and therefore the balance of strength and ductility is improved.

(ii) To improve the bendability of high strength steel sheet, it is well known that it is effective to perform decarburization to soften the surface layer part. However, if softening the surface layer part, in some cases, the bending deformation load fell from the deformation load expected from the strength of the steel sheet. To solve this problem, the inventors discovered that if limiting the rate of change (increase rate) in the thickness direction of the area ratio of the hard substance martensite from the surface of the steel sheet to the inside of the steel sheet to a predetermined value or less, this problem can be overcome. Further, to realize such control of the metallic structure, in a continuous hot dip galvanization heat treatment step, first the steel sheet is heated to a 650° C. or more high temperature region and the atmosphere inside the furnace is rendered a high oxygen potential so as to form a decarburized region at the surface layer. After that, the steel sheet is cooled to the 600° C. or less low temperature region, the atmosphere in the furnace is rendered a low oxygen potential, and the steel sheet is held there isothermally for a certain time period or longer. Due to this isothermal holding operation, the carbon atoms inside the steel sheet are suitably diffused to the decarburized region of the surface layer. As a result, the inventors discovered that the rate of change in the thickness direction of the area ratio of the martensite finally formed becomes more moderate compared with the case of not performing the isothermal holding operation. However, this isothermal holding step has to be performed before the step of cooling down to the Ms or less explained in the above (i). This is because if the austenite transforms to martensite, the dissolved carbon will precipitate inside the martensite as carbides, and therefore rediffusion of carbon atoms from the inside of the steel sheet to the surface layer of the steel sheet will not occur.

(iii) Further, the inventors discovered that the effect of the above (ii) is manifested more if the cold rolling conditions before the continuous hot dip galvanization heat treatment are within predetermined ranges. The details are not clear, but it is believed that by limiting the cold rolling conditions to predetermined ranges, the shear strain imparted to the surface layer of the steel sheet becomes larger. If annealing steel sheet having such surface layer strain in the continuous hot dip galvanization heat treatment step, the structures at the surface layer of the steel sheet become finer. That is, the area of crystal grain boundaries at the surface layer part of the steel sheet increases. Since the crystal grain boundaries act as paths for diffusion of carbon atoms, as a result of the increase in the area of the crystal grain boundaries, it is believed that carbon atoms easily rediffuse to the surface layer when holding isothermally at 600° C. or less.

The present invention was made based on the above findings and specifically is as follows:

(1) A hot dip galvanized steel sheet comprising a base steel sheet and a hot dip galvanized layer on at least one surface of the base steel sheet, wherein the base steel sheet has a chemical composition comprising, by mass %, C: 0.050% to 0.350%,
Si: 0.10% to 2.50%,
Mn: 1.00% to 3.50%,
P: 0.050% or less,
S: 0.0100% or less,
Al: 0.001% to 1.500%,
N: 0.0100% or less,
O: 0.0100% or less,
Ti: 0% to 0.200%,
B: 0% to 0.0100%,
V: 0% to 1.00%,
Nb: 0% to 0.100%,
Cr: 0% to 2.00%,
Ni: 0% to 1.00%,
Cu: 0% to 1.00%,
Co: 0% to 1.00%,
Mo: 0% to 1.00%,
W: 0% to 1.00%,
Sn: 0% to 1.00%,
Sb: 0% to 1.00%,
Ca: 0% to 0.0100%,
Mg: 0% to 0.0100%,
Ce: 0% to 0.0100%,
Zr: 0% to 0.0100%,
La: 0% to 0.0100%,
Hf: 0% to 0.0100%,
Bi: 0% to 0.0100%,
REM other than Ce and La: 0% to 0.0100% and
a balance of Fe and impurities, a steel microstructure at a range of ⅛ thickness to ⅜ thickness centered about a position of ¼ thickness from a surface of the base steel sheet contains, by area %, ferrite: 0% to 50%,
retained austenite: 0% to 30%,
tempered martensite: 5% or more,
fresh martensite: 0% to 10%, and
pearlite and cementite in total: 0% to 5%, when there are remaining structures, the remaining structures consist of bainite, when defining a region having a hardness of 90% or less of the hardness at a position of ¼ thickness to the base steel sheet side from an interface of the base steel sheet and the hot dip galvanized layer as a "soft layer", there is a soft layer having a thickness of 10 μm or more at the base steel sheet side from the interface, the soft layer contains tempered martensite, and an increase rate in a thickness direction of an area % of tempered martensite from the interface to the inside of the base steel sheet inside the soft layer is 5.0%/μm or less.

(2) The hot dip galvanized steel sheet according to (1), wherein the steel microstructure further contains, by area %, retained austenite: 6% to 30%.

(3) A method for producing the hot dip galvanized steel sheet according to (1) or (2), comprising a hot rolling step for hot rolling a slab having the chemical composition according to (1), a cold rolling step for cold rolling the obtained hot rolled steel sheet, and a hot dip galvanizing step for hot dip galvanizing the obtained cold rolled steel sheet, wherein (A) the cold rolling step satisfies the conditions of the following (A1) and (A2):

(A1) a rolling line load satisfies the following formula (1) and cold rolling with a rolling reduction of 6% or more is performed one time or more:

$$13 \leq A/B \leq 35 \quad (1)$$

(where A is the rolling line load (kgf/mm) and B is the tensile strength of the hot rolled steel sheet (kgf/mm$^2$))

(A2) a total cold rolling reduction is 30 to 80%, and (B) the hot dip galvanizing step comprises heating the steel sheet to first soak it, first cooling then second soaking the first soaked steel sheet, dipping the second soaked steel sheet in a hot dip galvanizing bath, second cooling the coated steel sheet, and heating the second cooled steel sheet then third soaking it, and further satisfies the conditions of the following (B1) to (B6):

(B1) in the heating of the steel sheet before the first soaking, an average heating rate from 650° C. to a maximum heating temperature of Ac1° C.+30° C. or more and 950° C. or less is 0.5° C./s to 10.0° C./s in an atmosphere satisfying the following formulas (2) and (3), (B2) the steel sheet is held at the maximum heating temperature for 1 second to 1000 seconds (first soaking), (B3) an average cooling rate in a temperature range of 700 to 600° C. at the first cooling is 10 to 100° C./s, (B4) the first cooled steel sheet is held in a range of 300 to 600° C. for 80 seconds to 500 seconds in an atmosphere satisfying the following formulas (4) and (5) (second soaking), (B5) the second cooling is performed down to Ms-50° C. or less, and (B6) the second cooled steel sheet is heated to a temperature region of 200 to 420° C., then held in the temperature region for 5 to 500 seconds (third soaking).

$$-1.10 \leq \log(PH_2O/PH_2) \leq -0.07 \quad (2)$$

$$0.010 \leq PH_2 \leq 0.150 \quad (3)$$

$$\log(PH_2O/PH_2) < -1.10 \quad (4)$$

$$0.0010 \leq PH_2 \leq 0.1500 \quad (5)$$

(where $PH_2O$ represents the partial pressure of water vapor and $PH_2$ represents the partial pressure of hydrogen).

Advantageous Effects of Invention

According to the present invention, it is possible to obtain hot dip galvanized steel sheet excellent in press formability, specifically ductility, hole expandability, and bendability and further suppressed in drop in load at time of bending.

DESCRIPTION OF EMBODIMENTS

<Hot Dip Galvanized Steel Sheet>

Figure 1:
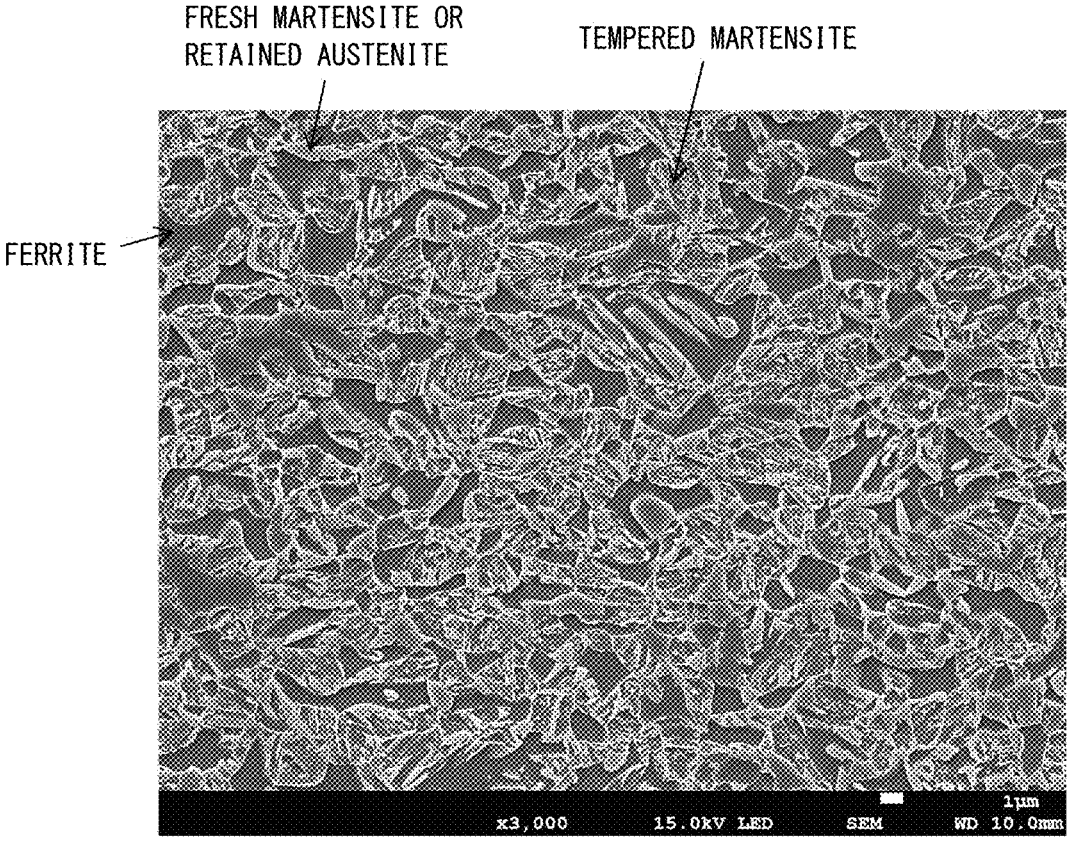
FIG. 1 shows a reference view of an SEM secondary electron image.

The hot dip galvanized steel sheet according to the embodiment of the present invention comprises a base steel sheet and a hot dip galvanized layer on at least one surface of the base steel sheet, wherein the base steel sheet has a chemical composition comprising, by mass %, C: 0.050% to 0.350%,
Si: 0.10% to 2.50%,
Mn: 1.00% to 3.50%,
P: 0.050% or less,
S: 0.0100% or less,
Al: 0.001% to 1.500%,
N: 0.0100% or less,
O: 0.0100% or less,
Ti: 0% to 0.200%,
B: 0% to 0.0100%,
V: 0% to 1.00%,
Nb: 0% to 0.100%,
Cr: 0% to 2.00%,
Ni: 0% to 1.00%,
Cu: 0% to 1.00%,
Co: 0% to 1.00%,
Mo: 0% to 1.00%,
W: 0% to 1.00%,
Sn: 0% to 1.00%,
Sb: 0% to 1.00%,
Ca: 0% to 0.0100%,
Mg: 0% to 0.0100%,
Ce: 0% to 0.0100%,
Zr: 0% to 0.0100%,
La: 0% to 0.0100%,
Hf: 0% to 0.0100%,
Bi: 0% to 0.0100%,
REM other than Ce and La: 0% to 0.0100% and
a balance of Fe and impurities, a steel microstructure at a range of ⅛ thickness to ⅜ thickness centered about a position of ¼ thickness from a surface of the base steel sheet contains, by area %, ferrite: 0% to 50%,
retained austenite: 0% to 30%,
tempered martensite: 5% or more,
fresh martensite: 0% to 10%, and
pearlite and cementite in total: 0% to 5%, when there are remaining structures, the remaining structures consist of bainite, when defining a region having a hardness of 90% or less of the hardness at a position of ¼ thickness to the base steel sheet side from an interface of the base steel sheet and the hot dip galvanized layer as a "soft layer", there is a soft layer having a thickness of 10 μm or more at the base steel sheet side from the interface, the soft layer contains tempered martensite, and an increase rate in a thickness direction of an area % of tempered martensite from the interface to the inside of the base steel sheet inside the soft layer is 5.0%/μm or less.

[Chemical Composition]

First, the reasons for limitation of the chemical composition of the base steel sheet according to the embodiment of the present invention (below, also simply referred to as the "steel sheet") as described above will be explained. In this Description, the "%" used in prescribing the chemical composition are all "mass %" unless otherwise indicated. Further, in this Description, "to" when showing the ranges of numerical values unless otherwise indicated will be used in the sense including the lower limit values and upper limit values of the numerical values described before and after it.

[C: 0.050% to 0.350%]

C is an element essential for securing the steel sheet strength. If less than 0.050%, the required high strength cannot be obtained, and therefore the content of C is 0.050% or more. The content of C may be 0.070% or more, 0.080% or more, or 0.100% or more as well. On the other hand, if more than 0.350%, the workability or weldability falls, and therefore the content of C is 0.350% or less. The content of C may be 0.340% or less, 0.320% or less, or 0.300% or less as well.

[Si: 0.10% to 2.50%]

Si is an element suppressing formation of iron carbides and contributing to improvement of strength and shapeability, but excessive addition causes the weldability of the steel sheet to deteriorate. Therefore, the content is 0.10 to 2.50%. The content of Si may be 0.20% or more, 0.30% or more, 0.40% or more, or 0.50% or more as well and/or may be 2.20% or less, 2.00% or less, or 1.90% or less as well.

[Mn: 1.00% to 3.50%]

Mn (manganese) is a powerful austenite stabilizing element and an element effective for increasing the strength of the steel sheet. Excessive addition causes the weldability or low temperature toughness to deteriorate. Therefore, the content is 1.00 to 3.50%. The content of Mn may be 1.10% or more or 1.30% or more or 1.50% or more as well and/or may be 3.30% or less, 3.10% or less, or 3.00% or less as well.

[P: 0.050% or less]

P (phosphorus) is a solution strengthening element and an element effective for increasing the strength of the steel sheet. Excessive addition causes the weldability and toughness to deteriorate. Therefore, the content of P is limited to 0.050% or less. Preferably it is 0.045% or less, 0.035% or less, or 0.020% or less. However, since extreme reduction of the content of P would result in high dephosphorizing costs, from the viewpoint of economics, a lower limit of 0.001% is preferable.

[S: 0.0100% or less]

S (sulfur) is an element contained as an impurity and forms MnS in steel to cause the toughness and hole expandability to deteriorate. Therefore, the content of S is restricted to 0.0100% or less as a range where the toughness and hole expandability do not remarkably deteriorate. Preferably it is 0.0050% or less, 0.0040% or less, or 0.0030% or less. However, since extreme reduction of the content of S would result in high desulfurizing costs, from the viewpoint of economics, a lower limit of 0.001% is preferable.

[Al: 0.001% to 1.500%]

Al (aluminum) is added in at least 0.001% for deoxidation of the steel. However, even if excessively adding it, not only does the effect become saturated and is a rise in cost invited, but also the transformation temperature of the steel is raised and the load at the time of hot rolling is increased. Therefore, an amount of Al of 1.500% is the upper limit. Preferably it is 1.200% or less, 1.000% or less, or 0.800% or less.

[N: 0.0100% or less]

N (nitrogen) is an element contained as an impurity. If its content is more than 0.0100%, it forms coarse nitrides in the steel and causes deterioration of the bendability and hole expandability. Therefore, the content of N is limited to 0.0100% or less. Preferably it is 0.0080% or less, 0.0060% or less, or 0.0050% or less. However, since extreme reduction of the content of N would result in high denitriding costs, from the viewpoint of economics, a lower limit of 0.0001% is preferable.

[O: 0.0100% or less]

O (oxygen) is an element contained as an impurity. If its content is more than 0.0100%, it forms coarse oxides in the steel and causes deterioration of the bendability and hole expandability. Therefore, the content of O is limited to 0.0100% or less. Preferably it is 0.0080% or less, 0.0060% or less, or 0.0050% or less. However, from the viewpoint of the producing costs, a lower limit of 0.0001% is preferable.

The basic chemical composition of the base steel sheet according to the embodiment of the present invention is as explained above. The base steel sheet may further contain the following elements according to need.

[V: 0% to 1.00%, Nb: 0% to 0.100%, Ti: 0% to 0.200%, B: 0% to 0.0100%, Cr: 0% to 2.00%, Ni: 0% to 1.00%, Cu: 0% to 1.00%, Co: 0% to 1.00%, Mo: 0% to 1.00%, W: 0% to 1.00%, Sn: 0% to 1.00%, and Sb: 0% to 1.00%]

V (vanadium), Nb (niobium), Ti (titanium), B (boron), Cr (chromium), Ni (nickel), Cu (copper), Co (cobalt), Mo (molybdenum), W (tungsten), Sn (tin), and Sb (antimony) are all elements effective for raising the strength of steel sheet. For this reason, one or more of these elements may be added in accordance with need. However, if excessively adding these elements, the effect becomes saturated and in particular an increase in cost is invited. Therefore, the contents are V: 0% to 1.00%, Nb: 0% to 0.100%, Ti: 0% to 0.200%, B: 0% to 0.0100%, Cr: 0% to 2.00%, Ni: 0% to 1.00%, Cu: 0% to 1.00%, Co: 0% to 1.00%, Mo: 0% to 1.00%, W: 0% to 1.00%, Sn: 0% to 1.00%, and Sb: 0% to 1.00%. The elements may also be 0.005% or more or 0.010% or more. In particular, the content of B may be 0.0001% or more or 0.0005% or more.

[Ca: 0% to 0.0100%, Mg: 0% to 0.0100%, Ce: 0% to 0.0100%, Zr: 0% to 0.0100%, La: 0% to 0.0100%, Hf: 0% to 0.0100%, Bi: 0% to 0.0100%, and REM other than Ce and La: 0% to 0.0100%]

Ca (calcium), Mg (magnesium), Ce (cerium), Zr (zirconium), La (lanthanum), Hf (hafnium), and REM (rare earth elements) other than Ce and La are elements contributing to microdiffusion of inclusions in the steel. Bi (bismuth) is an element lightening the microsegregation of Mn, Si, and other substitution type alloying elements in the steel. Since these respectively contribute to improvement of the workability of steel sheet, one or more of these elements may be added in accordance with need. However, excessive addition causes deterioration of the ductility. Therefore, a content of 0.0100% is the upper limit. Further, the elements may be 0.0005% or more or 0.0010% or more as well.

In the base steel sheet according to the embodiment of the present invention, the balance other than the above elements is comprised of Fe and impurities. "Impurities" are constituents entering due to various factors in the producing process, first and foremost the raw materials such as the ore and scrap, when industrially producing the base steel sheet and encompass all constituents not intentionally added to the base steel sheet according to the embodiment of the present invention. Further, "impurities" encompass all elements other than the constituents explained above contained in the base steel sheet in levels where the actions and effects distinctive to those elements do not affect the properties of the hot dip galvanized steel sheet according to the embodiment of the present invention.

[Steel Structures Inside Steel Sheet]

Next, the reasons for limitation of the internal structure of the base steel sheet according to the embodiment of the present invention will be explained.

[Ferrite: 0 to 50%]

Ferrite is a soft structure excellent in ductility. It may be included to improve the elongation of steel sheet in accordance with the demanded strength or ductility. However, if excessively contained, it becomes difficult to secure the desired steel sheet strength. Therefore, the content is an area % of 50% as the upper limit and may be 45% or less, 40% or less, or 35% or less. The content of ferrite may be an area % of 0%. For example, it may be 3% or more, 5% or more, or 10% or more.

[Tempered Martensite: 5% or More]

Tempered martensite is a high strength tough structure and is an essential metallic structure in the present invention. To balance the strength, ductility, and hole expandability at a high level, it is included in an area % of at least 5% or more. Preferably, it is an area % of 10% or more. It may be 15% or more or 20% or more as well. For example, the content of the tempered martensite may be an area % of 95% or less, 90% or less, 85% or less, 80% or less, or 70% or less.

[Fresh Martensite: 0 to 10%]

In the present invention, fresh martensite means martensite which is not tempered, i.e., martensite not containing carbides. This fresh martensite is a brittle structure, so becomes a starting point of fracture at the time of plastic deformation and causes deterioration of the local ductility of the steel sheet. Therefore, the content is an area % of 0 to 10%. More preferably it is 0 to 8% or 0 to 5%. The content of fresh martensite may be an area % of 1% or more or 2% or more.

[Retained Austenite: 0% to 30%]

Retained austenite improves the ductility of steel sheet due to the TRIP effect of transformation into martensite due to work induced transformation during deformation of steel sheet. On the other hand, to obtain a large amount of retained austenite, it is necessary to include large amounts of C and other alloying elements. For this reason, the upper limit value of the retained austenite is an area % of 30%. It may also be 25% or less or 20% or less. However, if trying to improve the ductility of steel sheet, the content is preferably an area % of 6% or more. It may also be 8% or more or 10% or more. If making the content of the retained austenite 6% or more, the content of Si in the base steel sheet is preferably a mass % of 0.50% or more.

[Pearlite and Cementite in Total: 0 to 5%]

Pearlite includes hard coarse cementite and forms a starting point of fracture at the time of plastic deformation, so causes the local ductility of the steel sheet to deteriorate. Therefore, the content, together with the cementite, is an area % of 0 to 5%. It may also be 0 to 3% or 0 to 2%.

The remaining structures besides the above structures may be 0%, but if there are any present, they are bainite. The remaining bainite structures may be upper bainite or lower bainite or may be mixed structures of the same.

[Presence of Soft Layer Having Thickness of 10 μm or More at Base Steel Sheet Side from Interface of Base Steel Sheet and Hot Dip Galvanized Layer]

The base steel sheet according to the present embodiment has a soft layer at its surface. In the present invention, the "soft layer" means a region in the base steel sheet having a hardness of 90% or less of the hardness at a position of ¼ thickness at the base steel sheet side from the interface of the base steel sheet and hot dip galvanized layer. The thickness of the soft layer is 10 μm or more. If the thickness of the soft layer falls below 10 μm, the bendability deteriorates. The thickness of the soft layer may for example also be 15 μm or more, 18 μm or more, 20 μm or more, or 30 μm or more and/or may be 120 μm or less, 100 μm or less, or 80 μm or less. Further, the hardness (Vickers hardness) at a position of ¼ thickness at the base steel sheet side from the interface of the base steel sheet and hot dip galvanized layer is generally 200 to 600 HV. For example, it may be 250 HV or more or 300 HV or more and/or may be 550 HV or less or 500 HV or less. The normal Vickers hardness (HV) is 1/3.2 or so the tensile strength (MPa).

[Increase Rate in Thickness Direction of Area % of Tempered Martensite from Interface to Inside of Base Steel Sheet Inside Soft Layer of 5.0%/μm or Less]

In the hot dip galvanized steel sheet according to an embodiment of the present invention, the soft layer contains tempered martensite. The increase rate in the thickness direction of the area % of tempered martensite from the interface of the base steel sheet and hot dip galvanized layer to the inside of the base steel sheet is 5.0%/μm or less. If over 5.0%/μm, the drop in load at the time of bending deformation becomes remarkable. For example, the increase rate in the thickness direction may be 4.5%/μm or less, 4.0%/μm or less, 3.0%/μm or less, 2.0%/μm or less, or 1.0%/μm or less. The lower limit value of the increase rate in the thickness direction is not particularly limited, but is for example 0.1%/μm or 0.2%/μm.

The fractions of the steel structures of the hot dip galvanized steel sheet are evaluated by the SEM-EBSD method (electron backscatter diffraction method) and SEM secondary electron image observation.

First, a sample is taken from the cross-section of thickness of the steel sheet parallel to the rolling direction so that the cross-section of thickness at the center position in the width direction becomes the observed surface. The observed surface is machine polished and finished to a mirror surface, then electrolytically polished. Next, in one or more observation fields at a range of ⅛ thickness to ⅜ thickness centered about ¼ thickness from the surface of the base steel sheet at the observed surface, a total area of $2.0\times10^{-9}$ $m^2$ or more is analyzed for crystal structures and orientations by the SEM-EBSD method. The data obtained by the EBSD method is analyzed using "OIM Analysis 6.0" made by TSL. Further, the distance between evaluation points (steps) is 0.03 to 0.20 μm. Regions judged to be FCC iron from the results of observation are deemed retained austenite. Further, boundaries with differences in crystal orientation of 15 degrees or more are deemed grain boundaries to obtain a crystal grain boundary map.

Next, the same sample as that observed by EBSD is corroded by Nital and observed by secondary electron image for the same fields as observation by EBSD. Since observing the same fields as the time of EBSD measurement, Vickers indentations and other visual marks may be provided in advance. From the obtained secondary electron image, the area ratios of the ferrite, retained austenite, bainite, tempered martensite, fresh martensite, and pearlite are respectively measured. Regions having lower structures in the grains and having several variants of cementite, more specifically two or more variants, precipitating are judged to be tempered martensite (for example, see reference drawing of FIG. 1). Regions where cementite precipitates in lamellar form are judged to be pearlite (or pearlite and cementite in total). Regions which are small in brightness and in which no lower structures are observed are judged to be ferrite (for example, see reference drawing of FIG. 1). Regions which are large in brightness and in which lower structures are not revealed by etching are judged to be fresh martensite and retained austenite (for example, see reference drawing of FIG. 1). Regions not corresponding to any of the above regions are judged to be bainite. The area ratios of the same are calculated by the point counting method and used as the area ratios of the structures. The area ratio of the fresh martensite can be found by subtracting the area ratio of retained austenite found by X-ray diffraction.

The area ratio of retained austenite is measured by the X-ray diffraction method. At a range of ⅛ thickness to ⅜ thickness centered about ¼ thickness from the surface of the base steel sheet, a surface parallel to the sheet surface is polished to a mirror finish and measured for area ratio of FCC iron by the X-ray diffraction method. This is used as the area ratio of the retained austenite.

The increase rate in the thickness direction of the area % of tempered martensite according to an embodiment of the present invention is determined by the following technique.

First, the Nital corroded sample for observation of the microstructure is photographed to obtain a structural photo. Using that structural photo, the area fraction of tempered martensite is calculated by the point counting method for a region of a thickness of 10 μm×width of 100 μm or more from the interface of the base steel sheet and the hot dip galvanized layer toward the inside of the steel sheet every 10 μm. The increase rate in the thickness direction of the area % of tempered martensite is determined based on the value becoming the maximum slope in the soft layer when plotting the area fractions obtained for each 10 μm. For example, when the slope between two plotted points of the area fracture obtained in one region in the soft layer and the area fraction obtained in a region including other than the soft layer adjoining that region becomes the maximum slope, that slope is determined as the "increase rate in the thickness direction of the area % of tempered martensite from the interface in the soft layer to the inside of the base steel sheet".

The hardness from the surface layer of the steel sheet to the inside of the steel sheet is measured by the following technique. A sample is taken from the cross-section of thickness of the steel sheet parallel to the rolling direction so that the cross-section of thickness at the center position in the width direction becomes the observed surface. The observed surface is polished and finished to a mirror surface, then chemically polished using colloidal silica for removing the worked layer of the surface layer. At the observed surface of the sample obtained, using a microhardness measurement apparatus, starting from a position of a 5 μm depth from the surface-most layer down to a position of ¼ thickness of the thickness from the surface, a square pyramidal Vickers indenter having a vertex angle of 136° was pushed by a load of 2 g in the thickness direction of the steel sheet at 10 μm pitches. At this time, depending on the sizes of the Vickers indentations, sometimes the Vickers indentations will interfere with each other. In such a case, the Vickers indenter is pushed in a zigzag pattern to avoid interference. The Vickers hardness is measured for five points each at each thickness position and the average value is used as the hardness at that thickness position. The values between the data points are interpolated linearly to obtain a hardness profile in the depth direction. The thickness of the soft layer is found by reading from the hardness profile the depth position where the hardness becomes 90% or less of the hardness at the position of ¼ thickness.

(Hot Dip Galvanized Layer)

The base steel sheet according to the embodiment of the present invention has a hot dip galvanized layer on at least one surface, preferably on both surfaces. This coating layer may be a hot dip galvanized layer or hot dip galvannealed layer having any composition known to persons skilled in the art and may include Al and other additive elements in addition to Zn. Further, the amount of deposition of the coating layer is not particularly limited and may be a general amount of deposition.

<Method for Producing Hot Dip Galvanized Steel Sheet>

Next, the method for producing the hot dip galvanized steel sheet according to the embodiment of the present invention will be explained. The following explanation is meant to illustrate the characteristic method for producing the hot dip galvanized steel sheet according to the embodiment of the present invention and is not meant to limit the hot dip galvanized steel sheet to one produced by the production method explained below.

The method for producing the hot dip galvanized steel sheet comprises a hot rolling step for hot rolling a slab having the same chemical composition as the chemical composition explained above relating to the base steel sheet, a cold rolling step for cold rolling the obtained hot rolled steel sheet, and a hot dip galvanizing step for hot dip galvanizing the obtained cold rolled steel sheet, wherein (A) the hot rolling step satisfies the conditions of the following (A1) to (A2):

(A1) a rolling line load satisfies the following formula (1) and cold rolling with a rolling reduction of 6% or more is performed one time or more:

$$13 \leq A/B \leq 35 \quad (1)$$

(where A is the rolling line load (kgf/mm) and B is the tensile strength of the hot rolled steel sheet (kgf/mm$^2$))

(A2) a total cold rolling reduction is 30 to 80%, and (B) the hot dip galvanizing step comprises heating the steel sheet to first soak it, first cooling then second soaking the first soaked steel sheet, dipping the second soaked steel sheet in a hot dip galvanizing bath, second cooling the coated steel sheet, and heating the second cooled steel sheet then third soaking it, and further satisfies the conditions of the following (B1) to (B6):

(B1) in the heating of the steel sheet before the first soaking, an average heating rate from 650° C. to a maximum heating temperature of Ac1° C.+30° C. or more and 950° C. or less is 0.5° C./s to 10.0° C./s in an atmosphere satisfying the following formulas (2) and (3), (B2) the steel sheet is held at the maximum heating temperature for 1 second to 1000 seconds (first soaking), (B3) an average cooling rate in a temperature range of 700 to 600° C. at the first cooling is 10 to 100° C./s, (B4) the first cooled steel sheet is held in a range of 300 to 600° C. for 80 seconds to 500 seconds in an atmosphere satisfying the following formulas (4) and (5) (second soaking), (B5) the second cooling is performed down to Ms-50° C. or less, and (B6) the second cooled steel sheet is heated to a temperature region of 200 to 420° C., then held in the temperature region for 5 to 500 seconds (third soaking).

$$-1.10 \leq \log(PH_2O/PH_2) \leq -0.07 \quad (2)$$

$$0.010 \leq PH_2 \leq 0.150 \quad (3)$$

$$\log(PH_2O/PH_2) < -1.10 \quad (4)$$

$$0.0010 \leq PH_2 \leq 0.1500 \quad (5)$$

(where $PH_2O$ represents the partial pressure of water vapor and $PH_2$ represents the partial pressure of hydrogen).

Below, the method for producing the hot dip galvanized steel sheet will be explained in detail.

[(A) Hot Rolling Step]

In this method, the hot rolling step is not particularly limited and can be performed under any suitable conditions. Therefore, the following explanation relating to the hot rolling step is intended as a simple illustration and is not intended to limit the hot rolling step in the present method to one performed under the specific conditions as explained below.

First, in the hot rolling step, a slab having the same chemical composition as the chemical composition explained above relating to the base steel sheet is heated before hot rolling. The heating temperature of the slab is not particularly limited, but for sufficient dissolution of the borides, carbides, etc., generally 1150° C. or more is preferable. The steel slab used is preferably produced by the continuous casting method from the viewpoint of producing ability, but may also be produced by the ingot making method or thin slab casting method.

[Rough Rolling]

In this method, for example, the heated slab may be rough rolled before the finish rolling so as to adjust the sheet thickness etc. Such rough rolling is not particularly limited, it is preferable to perform it to give a total rolling reduction at 1050° C. or more of 60% or more. If the total rolling reduction is less than 60%, since the recrystallization during hot rolling becomes insufficient, sometimes this leads to unevenness of the structure of the hot rolled sheet. The above total rolling reduction may, for example, be 90% or less.

[Finish Rolling Inlet Side Temperature: 900 to 1050° C., Finish Rolling Exit Side Temperature: 850° C. to 1000° C., and Total Rolling Reduction: 70 to 95%]

The finish rolling is preferably performed in a range satisfying the conditions of a finish rolling inlet side temperature of 900 to 1050° C., a finish rolling exit side temperature of 850° C. to 1000° C., and a total rolling reduction of 70 to 95%. If the finish rolling inlet side temperature falls below 900° C., the finish rolling exit side temperature falls below 850° C., or the total rolling reduction exceeds 95%, the hot rolled steel sheet develops texture, so sometimes anisotropy appears in the final finished product sheet. On the other hand, if the finish rolling inlet side temperature rises above 1050° C., the finish rolling exit side temperature rises above 1000° C., or the total rolling reduction falls below 70%, the hot rolled steel sheet becomes coarser in crystal grain size sometimes leading to coarsening of the final finished product sheet structure and in turn deterioration of workability. For example, the finish rolling inlet side temperature may be 950° C. or more. The finish rolling exit side temperature may be 900° C. or more. The total rolling reduction may be 75% or more or 80% or more.

[Coiling Temperature: 450 to 680° C.]

The coiling temperature is 450 to 680° C. If the coiling temperature falls below 450° C., the strength of the hot rolled sheet becomes excessive and sometimes the cold rolling ductility is impaired. On the other hand, if the coiling temperature exceeds 680° C., the cementite coarsens and undissolved cementite remains, so sometimes the workability is impaired. The coiling temperature may be 500° C. or more and/or may be 650° C. or less.

In the present method, the obtained hot rolled steel sheet (hot rolled coil) may be pickled or otherwise treated as required. The hot rolled coil may be pickled by any ordinary method. Further, the hot rolled coil may be skin pass rolled to correct its shape and improve its pickling ability.

[(A) Cold Rolling Step]

[Performing Cold Rolling by Rolling Line Load Satisfying Formula (1) and Rolling Reduction of 6% or More One Time or More]

In this method, the obtained hot rolled steel sheet is supplied to the cold rolling step. The cold rolling step comprises performing cold rolling by a rolling line load satisfying the following formula (1) and by a rolling reduction of 6% or more one time or more:

$$13 \leq A/B \leq 35 \quad (1)$$

where A is a rolling line load (kgf/mm) and B is a tensile strength (kgf/mm$^2$) of the hot rolled steel sheet.

The cold rolling may be either the tandem system where a plurality of rolling stands are arranged in a line or the reverse mill system where a single rolling stand moves back and forth. The rolling line load varies depending on various factors such as the strength of the steel sheet before cold rolling plus the coarseness of the steel sheet before cold rolling, the diameter of the work rolls, the surface roughness of the work rolls, the rotational speed of the work rolls, the tension, and amount, temperature, and viscosity of the emulsion, etc. However, the rolling line load becoming higher means the frictional force occurring at the interface of the steel sheet and the work rolls becoming greater. The larger the frictional force, the larger the shear strain given to the surface layer of the steel sheet, the more recrystallization at the surface layer part of the steel sheet is promoted at the time of heating in the later hot dip galvanization step, and the finer the structures of the surface layer of the steel sheet. Refining the structures means the area of the crystal grain boundaries forming paths for diffusion of carbon becoming greater. As a result, rediffusion of carbon atoms from the inside of the steel sheet to the surface layer at the time of the second soaking treatment is promoted. To obtain this effect, it is necessary to control the rolling line load so that A/B becomes 13 or more and the rolling reduction becomes 6% or more. On the other hand, if the rolling line load becomes excessively large, the burden on the cold rolling mill increases, and the facilities may be damaged, so the upper limit of A/B is 35. A/B may be 20 or more and/or may be 30 or less. Further, the rolling reduction may be 10% or more and/or 25% or less. In the prior art, for example, there was no practice of controlling A (rolling line load)/B (tensile strength of hot rolled steel sheet) to within a predetermined range to make the structures at the surface layer of the steel sheet finer. Further, the fact that it is possible to refine the structures at the surface layer of steel sheet by such control was not known in the past either. That is to say, the rolling line load changes depending on the capacity of the cold rolling mill. Further, the tensile strength of the hot rolled steel sheet also changes depending on the chemical composition and steel structures etc., so it is not easy to control the ratio of these, i.e., the rolling line load/tensile strength of hot rolled steel sheet, to within the desired range.

For the tensile strength of the hot rolled steel sheet, a JIS No. 5 tensile test piece is taken from the hot rolled steel sheet using the width direction from near the center as the longitudinal direction of the test piece and is subjected to a tensile test based on JIS Z2241: 2011 for measurement. For measurement of the rolling line load, usually this is measured constantly as an operation management parameter, but for example it is also possible to use a load cell or other measurement device attached to the rolling mill.

[Total Cold Rolling Reduction: 30 to 80%]

The cold rolling reduction is limited to a total of 30 to 80%. If lower than 30%, the accumulation of strain becomes insufficient and the effect of refining the structures at the surface layer cannot be obtained. On the other hand, excessive reduction results in excessive rolling load and invites an increase in burden at the cold rolling mill, so the upper limit is preferably made 80%. For example, the total cold rolling reduction may be 40% or more and/or may be 70% or less or 60% or less.

[(B) Hot Dip Galvanization Step]

[Average Heating Rate from 650° C. to Maximum Heating Temperature of Ac1+30° C. or More and 950° C. or Less in Atmosphere Satisfying Formulas (2) and (3): 0.5 to 10.0° C./s]

In this method, after the cold rolling step, the obtained steel sheet is coated in a hot dip galvanization step. In the hot dip galvanization step, first, the steel sheet is heated and subjected to first soaking treatment in an atmosphere satisfying the following formulas (2) and (3). At the time of heating the steel sheet, the average heating rate from 650° C. to the maximum heating temperature of Ac1+30° C. or more and 950° C. or less is limited to 0.5 to 10.0° C./s. If the heating rate is more than 10.0° C./s, the recrystallization of ferrite does not sufficiently proceed and sometimes the elongation of the steel sheet becomes poor. On the other hand, if the average heating rate falls below 0.5° C./s, the austenite becomes coarse, so sometimes the finally obtained steel structures become coarse. This average heating rate may be 1.0° C./or more and/or may be 8.0° C./s or less or 5.0° C./s or less. In the present invention, the "average heating rate" means the value obtained by dividing the difference between 650° C. and the maximum heating temperature by the elapsed time from 650° C. to the maximum heating temperature.

The atmosphere in the furnace during the above heating satisfies the following formulas (2) and (3). Here, the $\log(PH_2O/PH_2)$ in formula (2) is the log of the ratio of the water vapor partial pressure ($PH_2O$) and hydrogen partial pressure ($PH_2$) in the atmosphere and is also called the oxygen potential. If the $\log(PH_2O/PH_2)$ falls below −1.10, 10 μm or more of a soft layer is not formed at the surface layer part of the steel sheet in the final structure. On the other hand, if the $\log(PH_2O/PH_2)$ becomes more than −0.07, the decarburization reaction excessively proceeds and a drop in strength is invited. Further, the wettability with the coating becomes poor and noncoating and other defects are sometimes caused. If $PH_2$ falls below 0.010, oxides are formed outside of the steel sheet, the wettability with the coating becomes poor, and noncoating and other defects are sometimes caused. The upper limit of $PH_2$ is 0.150 from the viewpoint of the danger of hydrogen explosion. For example, $\log(PH_2O/PH_2)$ may be −1.00 or more and/or may be −0.10 or less. Further, $PH_2$ may be 0.020 or more and/or may be 0.120 or less.

$$-1.10 \leq \log(PH_2O/PH_2) \leq -0.07 \quad (2)$$

$$0.010 \leq PH_2 \leq 0.150 \quad (3)$$

[First Soaking Treatment: Holding at Maximum Heating Temperature of Ac1+30° C. or More and 950° C. or Less for 1 Second to 1000 Seconds]

To cause sufficient austenite transformation to proceed, the steel sheet is heated to at least Ac1+30° C. or more and held at that temperature (maximum heating temperature) as soaking treatment. However, if excessively raising the heating temperature, not only is deterioration of the toughness due to coarsening of the austenite grain size invited, but also damage to the annealing facilities is led to. For this reason, the upper limit is 950° C., preferably 900° C. If the soaking time is short, austenite transformation does not sufficiently proceed, so the time is at least 1 second or more. Preferably it is 30 seconds or more or 60 seconds or more. On the other hand, if the soaking time is too long, the productivity is decreased, so the upper limit is 1000 seconds, preferably 500 seconds. During soaking, the steel sheet does not necessarily have to be held at a constant temperature. It may also fluctuate within a range satisfying the above conditions. The "holding" in the first soaking treatment and the later explained second soaking treatment and third soaking treatment means maintaining the temperature within a range of a predetermined temperature±20° C., preferably ±10° C., in a range not exceeding the upper limit value and lower limit value prescribed in the soaking treatments. Therefore, for example, a heating or cooling operation which gradually heats or gradually cools whereby the temperature fluctuates by more than 40° C., preferably 20° C., with the temperature ranges prescribed in the soaking treatments are not included in the first, second, and third soaking treatments according to the embodiment of the present invention.

[First Cooling: Average Cooling Rate in Temperature Range of 700 to 600° C.: 10 to 100° C./s]

After holding at the maximum heating temperature, the steel sheet is cooled by the first cooling. The cooling stop temperature is 300° C. to 600° C. of the following second soaking treatment temperature. The average cooling rate in a temperature range of 700° C. to 600° C. is 10 to 100° C./s. If the average cooling rate is less than 10° C./s, sometimes the desired ferrite fraction cannot be obtained. The average cooling rate may be 15° C./s or more or 20° C./s or more. Further, the average cooling rate may also be 80° C./s or less or 60° C./s or less. In the present invention, "the average cooling rate" means the value obtained by dividing the temperature difference between 700° C. and 600° C., i.e., 100° C., by the elapsed time from 700° C. to 600° C.

[Second Soaking Treatment: Holding in Range of 300° C. to 600° C. for 80 to 500 Seconds in Atmosphere Satisfying Formulas (4) and (5)]

Second soaking treatment holding the steel sheet in a range of 300° C. to 600° C. for 80 to 500 seconds is performed by making the atmosphere in the furnace a low oxygen potential and causing the carbon atoms in the steel sheet to suitably rediffuse toward the decarburized region formed at the time of the previous heating. If the temperature of the second soaking treatment falls below 300° C. or the holding time falls below 80 seconds, the rediffusion of the carbon atoms will become insufficient, so the desired surface layer structures cannot be obtained. On the other hand, if the temperature of the second soaking treatment becomes more than 600° C., ferrite transformation will proceed and the desired ferrite fraction will not be able to be obtained. If the holding time becomes more than 500 seconds, bainite transformation will excessively proceed, so the metal structures according to the embodiment of the present invention will not be able to be obtained. If $\log(PH_2O/PH_2)$ becomes more than −1.10, decarburization will proceed and the desired surface structures will not be able to be obtained. Further, if $PH_2$ falls below 0.0010, oxides will be formed outside of the steel sheet and the wettability with the coating will become poor and noncoating and other defects will sometimes be caused. The upper limit of $PH_2$ is 0.1500 from the viewpoint of the danger of hydrogen explosion. For example, log ($PH_2O/PH_2$) may be −1.00 or less. Further, $PH_2$ may be 0.0050 or more and/or may be 0.1000 or less.

$$\log(PH_2O/PH_2) < -1.10 \quad (4)$$

$$0.0010 \leq PH_2 \leq 0.1500 \quad (5)$$

After the second soaking treatment, the steel sheet is dipped in a hot dip galvanization bath. The steel sheet temperature at this time has little effect on the performance of the steel sheet, but if the difference between the steel sheet temperature and the coating bath temperature is too large, since the coating bath temperature will change and sometimes hinder operation, provision of a step for cooling the steel sheet to a range of the coating bath temperature −20° C. to the coating bath temperature +20° C. is desirable. The hot dip galvanization may be performed by an ordinary method. For example, the coating bath temperature may be 440 to 460° C. and the dipping time may be 5 seconds or less. The coating bath is preferably a coating bath containing Al in 0.08 to 0.2%, but as impurities, Fe, Si, Mg, Mn, Cr, Ti, and Pb may also be contained. Further, controlling the basis weight of the coating by gas wiping or another known method is preferable. The basis weight is preferably 25 to 75 g/m$^2$ per side.

[Alloying Treatment]

For example, the hot dip galvanized steel sheet formed with the hot dip galvanized layer may be treated to alloy it as required. In this case, if the alloying treatment temperature is less than 460° C., not only does the alloying rate becomes slower and is the productivity hindered, but also uneven alloying treatment occurs, so the alloying treatment temperature is 460° C. or more. On the other hand, if the alloying treatment temperature is more than 600° C., sometimes the alloying excessively proceeds and the coating adhesion of the steel sheet deteriorates. Further, sometimes pearlite transformation proceeds and the desired metallic structure cannot be obtained. Therefore, the alloying treatment temperature is 600° C. or less.

[Second Cooling: Cooling to Ms-50° C. or Less]

The steel sheet after the coating treatment or coating and alloying treatment is cooled by the second cooling which cools it down to the martensite transformation start temperature (Ms)-50° C. or less so as to make part or the majority of the austenite transform to martensite. The martensite produced here is tempered by the subsequent reheating and third soaking treatment to become tempered martensite. If the cooling stop temperature is more than Ms-50° C., since the tempered martensite is not sufficiently formed, the desired metallic structure is not obtained. If desiring to utilize the retained austenite for improving the ductility of the steel sheet, it is desirable to provide a lower limit to the cooling stop temperature. Specifically, the cooling stop temperature is desirably controlled to a range of Ms-50° C. to Ms-130° C.

Figure 2:
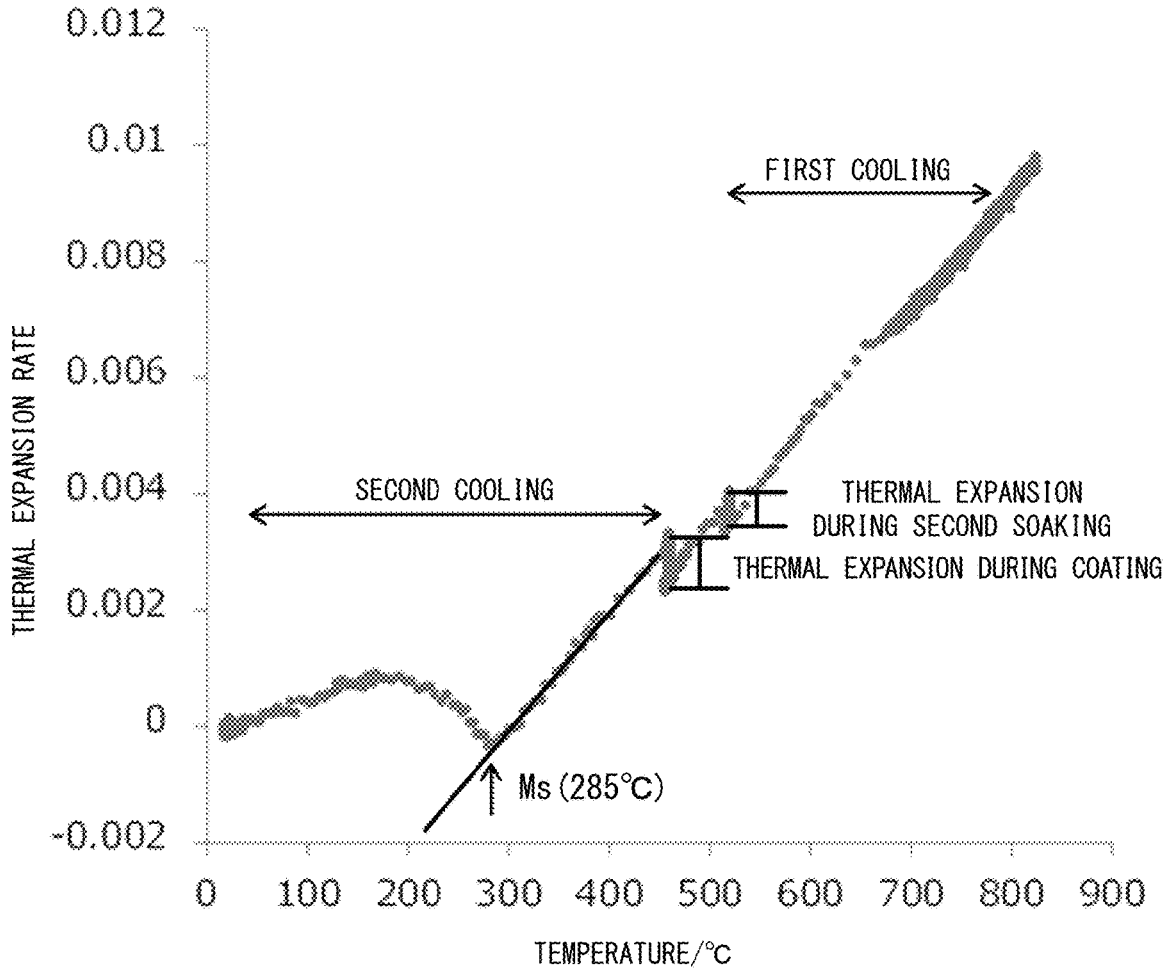
FIG. 2 is a temperature-thermal expansion curve when simulating a heat cycle corresponding to hot dip galvanization treatment according to the embodiment of the present invention by a thermal expansion measurement apparatus.
Figure 3:
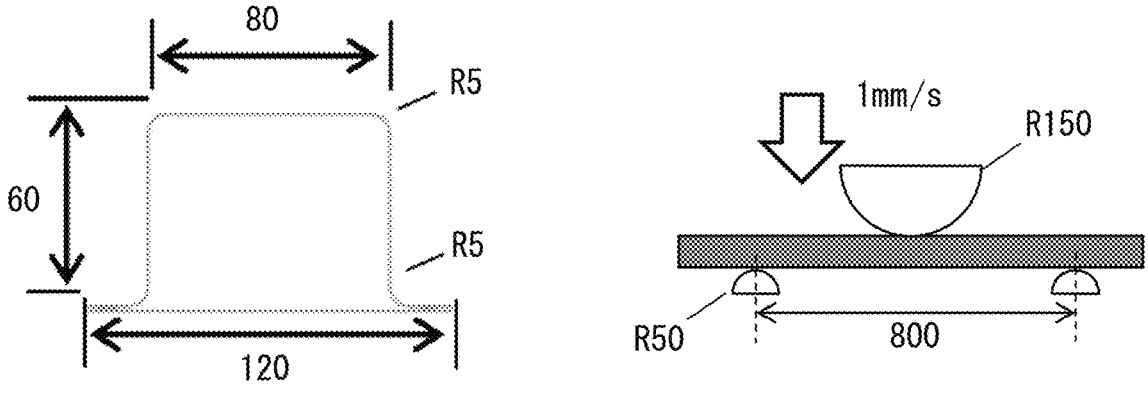
FIG. 3 is a view schematically showing a test method for evaluating bending deformation load.

The martensite transformation in the present invention occurs after the ferrite transformation and bainite transformation. Along with the ferrite transformation and bainite transformation, C is diffused in the austenite. For this reason, this does not match the Ms when heating to the austenite single phase and rapidly cooling. The Ms in the present invention is found by measuring the thermal expansion temperature in the second cooling. For example, the Ms in the present invention can be found by using a Formastor tester or other apparatus able to measure the amount of thermal expansion during continuous heat treatment, reproducing the heat cycle of the hot dip galvanization line from the start of hot dip galvanization heat treatment (corresponding to room temperature) to the above second cooling, and measuring the thermal expansion temperature at that second cooling. However, in actual hot dip galvanization heat treatment, sometimes cooling is stopped between Ms to room temperature, but at the time of measurement of thermal expansion, cooling is performed down to room temperature. FIG. 2 is a temperature-thermal expansion curve simulating by a thermal expansion measurement device a heat cycle corresponding to the hot dip galvanization treatment according to an embodiment of the present invention. Steel sheet linearly thermally contracts in the second cooling step, but departs from a linear relationship at a certain temperature. The temperature at this time is the Ms in the present invention.

[Third Soaking Treatment: Holding in Temperature Region of 200° C. to 420° C. for 5 to 500 Seconds]

After the second cooling, the steel sheet is reheated to a range of 200° C. to 420° C. for the third soaking treatment. In this step, the martensite produced at the time of the second cooling is tempered. If the holding temperature is less than 200° C. or the holding time is less than 5 seconds, the tempering does not sufficiently proceed. On the other hand, since the bainite transformation does not sufficiently proceed, it becomes difficult to obtain the desired amount of retained austenite. On the other hand, if the holding temperature is more than 420° C. or if the holding time is more than 500 seconds, since the martensite is excessively tempered and bainite transformation excessively proceeds, it becomes difficult to obtain the desired strength and metallic structure. The temperature of the third soaking treatment may be 240° C. or more and may be 400° C. or less. Further, the holding time may be 15 seconds or more or may be 100 seconds or more and may be 400 seconds or less.

After the third soaking treatment, the steel sheet is cooled down to room temperature to obtain the final finished product. The steel sheet may also be skin pass rolled to correct the flatness and adjust the surface roughness. In this case, to avoid deterioration of the ductility, the elongation rate is preferably 2% or less.

EXAMPLES

Next, examples of the present invention will be explained. The conditions in the examples are illustrations of conditions employed for confirming the workability and effects of the present invention. The present invention is not limited to these illustrations of conditions. The present invention can employ various conditions so long as not deviating from the gist of the present invention and achieving the object of the present invention.

Steels having the chemical compositions shown in Table 1 were cast to prepare slabs. The balance other than the constituents shown in Table 1 comprised Fe and impurities. These slabs were hot rolled under the conditions shown in Table 2 to produce hot rolled steel sheets. After that, the hot rolled steel sheets were pickled to remove the surface scale. After that, they were cold rolled. The sheet thicknesses after cold rolling were 1.4 mm. Further, the obtained steel sheets were continuously hot dip galvanized under the conditions shown in Table 2 and suitably treated for alloying. In the soaking treatments shown in Table 2, the temperatures were held within a range of the temperatures shown in Table 2±10° C. The chemical compositions of the base steel sheets obtained by analyzing samples taken from the produced hot dip galvanized steel sheets were equal with the chemical compositions of the steels shown in Table 1.

TABLE 1

| Steel type | C | Si | Mn | P | S | Al | N | O | Cr | Mo | V | Nb |
|---|---|---|---|---|---|---|---|---|---|---|---|---|
| A | 0.215 | 1.61 | 2.08 | 0.005 | 0.0021 | 0.021 | 0.0030 | 0.0007 | | | | |
| B | 0.243 | 0.96 | 1.52 | 0.006 | 0.0024 | 0.692 | 0.0018 | 0.0014 | 0.66 | | | |
| C | 0.195 | 0.72 | 2.60 | 0.010 | 0.0015 | 1.136 | 0.0024 | 0.0011 | | | | |
| D | 0.144 | 1.76 | 1.96 | 0.008 | 0.0020 | 0.031 | 0.0035 | 0.0004 | | | | |
| E | 0.190 | 1.75 | 2.57 | 0.007 | 0.0014 | 0.045 | 0.0018 | 0.0008 | | 0.16 | | 0.020 |
| F | 0.171 | 1.14 | 3.28 | 0.004 | 0.0007 | 0.257 | 0.0028 | 0.0006 | | | | |

TABLE 1-continued

| | | | | | | | | | | | | |
|---|---|---|---|---|---|---|---|---|---|---|---|---|
| G | 0.220 | 1.51 | 2.63 | 0.009 | 0.0011 | 0.008 | 0.0032 | 0.0010 | | | | |
| H | 0.318 | 1.87 | 2.41 | 0.012 | 0.0023 | 0.043 | 0.0025 | 0.0007 | 0.45 | 0.29 | | |
| I | 0.259 | 1.81 | 2.98 | 0.018 | 0.0014 | 0.017 | 0.0039 | 0.0009 | | | | |
| J | 0.326 | 1.43 | 2.69 | 0.012 | 0.0008 | 0.538 | 0.0028 | 0.0011 | | 0.38 | | |
| K | 0.088 | 1.02 | 2.20 | 0.010 | 0.0022 | 0.029 | 0.0038 | 0.0012 | | 0.04 | | |
| L | 0.080 | 0.45 | 2.41 | 0.015 | 0.0019 | 0.052 | 0.0030 | 0.0011 | 0.27 | 0.07 | | 0.009 |
| M | 0.112 | 0.75 | 2.66 | 0.015 | 0.0021 | 0.041 | 0.0041 | 0.0015 | | | 0.23 | 0.050 |
| N | 0.100 | 0.49 | 2.51 | 0.011 | 0.0009 | 0.008 | 0.0020 | 0.0008 | 0.52 | 0.10 | | |
| O | 0.224 | 0.27 | 2.37 | 0.005 | 0.0021 | 0.039 | 0.0021 | 0.0012 | | 0.24 | | |
| P | 0.205 | 1.02 | 2.56 | 0.006 | 0.0020 | 0.051 | 0.0038 | 0.0020 | 0.40 | | | 0.012 |
| Q | **0.043** | 1.55 | 2.53 | 0.019 | 0.0021 | 0.044 | 0.0026 | 0.0008 | | | | |
| R | 0.188 | 1.67 | **0.59** | 0.015 | 0.0008 | 0.048 | 0.0030 | 0.0012 | 0.51 | | | |
| S | 0.155 | 1.20 | **4.12** | 0.009 | 0.0025 | 0.049 | 0.0015 | 0.0017 | | | | |
| T | 0.164 | **2.51** | 2.50 | 0.009 | 0.0016 | 0.030 | 0.0015 | 0.0020 | | | | |
| U | **0.417** | 1.59 | 2.04 | 0.012 | 0.0005 | 0.044 | 0.0031 | 0.0019 | | | | |
| V | 0.206 | 0.56 | 2.96 | 0.016 | 0.0022 | **1.690** | 0.0033 | 0.0018 | | | | |

| Steel type | Ti | B | Cu | Ni | Co | W | Sn | Sb | Others | Ac1 |
|---|---|---|---|---|---|---|---|---|---|---|
| A | | | | | | | | | | 748 |
| B | 0.018 | 0.0021 | | | | | | | Bi: 0.0065 | 746 |
| C | | | | | | | | | | 716 |
| D | | | | | | | | | | 753 |
| E | 0.026 | 0.0010 | | | | | | | Ca: 0.0043 | 746 |
| F | | | 0.22 | 0.15 | | | | | | 719 |
| G | | 0.0008 | | | | | 0.10 | 0.08 | | 739 |
| H | | | | | | | | | | 759 |
| I | 0.022 | 0.0023 | | | | | | | Hf: 0.0037, La: 0.0050 | 744 |
| J | | | | | 0.38 | | | | | 736 |
| K | 0.033 | 0.0013 | | | | | | | | 729 |
| L | 0.024 | 0.0019 | | | | | | | Mg: 0.0044 | 715 |
| M | 0.038 | 0.0010 | | | | | | | Ce: 0.0052, REM: 0.010 | 716 |
| N | 0.009 | 0.0028 | | | | | | | Zr: 0.0079 | 719 |
| O | 0.022 | 0.0030 | | | | 0.15 | | | | 705 |
| P | 0.025 | 0.0022 | 0.15 | | | | | | | 732 |
| Q | | | | | | | | | | 741 |
| R | | | | | | | | | | 774 |
| S | | | | | | | | | | 714 |
| T | | | | | | | | | | 769 |
| U | | | | | | | | | | 747 |
| V | | | | | | | | | | 708 |

Bold underlines indicate outside scope of present invention.

Empty field in table indicates corresponding chemical constituent not intentionally added.

TABLE 2

| | | Hot rolling step | | | | | | Cold rolling step | | |
|---|---|---|---|---|---|---|---|---|---|---|
| No. | Steel type | Slab heating temp. ° C. | Rough rolling total rolling reduction at 1050° C. or more % | Finish inlet side temp. ° C. | Finish exit side temp. ° C. | Finish rolling total rolling reduction % | Coiling temp. ° C. | A/B | Maximum rolling reduction per stand % | Total cold rolling rate % |
| 1 | A | 1260 | 85 | 970 | 880 | 91 | 620 | 20 | 15 | 53 |
| 2 | A | 1240 | 85 | 1000 | 900 | 91 | 550 | 24 | 18 | 53 |
| 3 | A | 1250 | 85 | 1020 | 920 | 91 | 580 | 23 | 18 | 53 |
| 4 | A | 1250 | 85 | 1010 | 900 | 91 | 590 | 24 | 18 | 53 |
| 5 | A | 1230 | 85 | 1010 | 910 | 91 | 560 | 24 | 18 | 53 |
| 6 | A | 1250 | 85 | 1030 | 940 | 91 | 550 | 25 | 18 | 53 |
| 7 | A | 1250 | 85 | 1000 | 940 | 91 | 560 | 25 | 18 | 53 |
| 8 | A | 1270 | 85 | 1020 | 920 | 91 | 600 | 21 | 16 | 53 |
| 9 | A | 1240 | 85 | 990 | 900 | 91 | 580 | 22 | 16 | 53 |
| 10 | B | 1230 | 85 | 970 | 880 | 91 | 580 | 23 | 17 | 53 |
| 11 | B | 1260 | 85 | 1030 | 940 | 91 | 570 | 23 | 17 | 53 |
| 12 | B | 1240 | 85 | 1000 | 930 | 91 | 550 | 23 | 18 | 53 |
| 13 | B | 1250 | 85 | 1000 | 890 | 91 | 530 | **12** | 16 | 53 |
| 14 | B | 1240 | 85 | 960 | 900 | 91 | 550 | 23 | 16 | 53 |
| 15 | B | 1220 | 85 | 1010 | 920 | 91 | 560 | 23 | 18 | 53 |
| 16 | B | 1250 | 85 | 1000 | 920 | 91 | 580 | 24 | 18 | 53 |
| 17 | C | 1270 | 85 | 990 | 930 | 91 | 530 | 22 | 17 | 53 |
| 18 | C | 1260 | 85 | 1000 | 930 | 91 | 530 | 22 | 17 | 53 |
| 19 | C | 1270 | 85 | 990 | 930 | 91 | 530 | 22 | 17 | 53 |
| 20 | D | 1200 | 85 | 1010 | 950 | 91 | 600 | 25 | 18 | 53 |
| 21 | D | 1240 | 85 | 1000 | 910 | 91 | 570 | 25 | 17 | 53 |
| 22 | D | 1220 | 85 | 1010 | 950 | 91 | 570 | 25 | 18 | 53 |
| 23 | D | 1240 | 85 | 1020 | 930 | 91 | 590 | 24 | 18 | 53 |
| 24 | E | 1210 | 85 | 990 | 890 | 91 | 510 | 25 | 16 | 53 |
| 25 | E | 1280 | 85 | 1050 | 950 | 91 | 570 | 25 | 16 | 53 |
| 26 | E | 1250 | 85 | 1010 | 920 | 91 | 520 | 26 | 16 | 53 |
| 27 | E | 1240 | 85 | 1030 | 940 | 91 | 570 | 25 | 18 | 53 |
| 28 | E | 1260 | 85 | 1020 | 920 | 91 | 540 | 28 | 17 | 53 |
| 29 | E | 1230 | 85 | 980 | 900 | 91 | 550 | 25 | 19 | 53 |
| 30 | E | 1230 | 85 | 1000 | 900 | 91 | 550 | 27 | 15 | 53 |
| 31 | F | 1200 | 85 | 1040 | 950 | 91 | 530 | 23 | 17 | 53 |
| 32 | F | 1220 | 85 | 1030 | 930 | 91 | 550 | 21 | **5** | 33 |
| 33 | F | 1250 | 85 | 1040 | 920 | 91 | 560 | 23 | 17 | 53 |
| 34 | F | 1250 | 85 | 1030 | 930 | 91 | 550 | 23 | 17 | 53 |
| 35 | F | 1240 | 85 | 1040 | 930 | 91 | 570 | 23 | 18 | 53 |
| 36 | F | 1240 | 85 | 1000 | 900 | 91 | 580 | 25 | 17 | 53 |
| 37 | G | 1250 | 85 | 1010 | 900 | 91 | 620 | 25 | 17 | 53 |
| 38 | G | 1250 | 85 | 1020 | 920 | 91 | 540 | 25 | 17 | 53 |
| 39 | H | 1270 | 85 | 1010 | 900 | 91 | 620 | 28 | 15 | 53 |
| 40 | H | 1250 | 85 | 1000 | 900 | 91 | 590 | 27 | 16 | 53 |
| 41 | I | 1230 | 85 | 1020 | 920 | 91 | 600 | 25 | 16 | 53 |

TABLE 2-continued

| | | | | | | | | | | |
|---|---|---|---|---|---|---|---|---|---|---|
| 42 | I | 1260 | 85 | 1010 | 910 | 91 | 560 | 24 | 14 | 53 |
| 43 | J | 1230 | 85 | 1040 | 980 | 91 | 580 | 22 | 17 | 53 |
| 44 | J | 1240 | 85 | 1050 | 950 | 91 | 540 | 23 | 17 | 53 |
| 45 | K | 1260 | 85 | 970 | 900 | 91 | 570 | 27 | 18 | 53 |
| 46 | K | 1260 | 85 | 970 | 900 | 91 | 570 | 27 | 18 | 53 |
| 47 | L | 1260 | 85 | 1050 | 980 | 91 | 500 | 22 | 19 | 53 |
| 48 | L | 1260 | 85 | 1050 | 980 | 91 | 500 | 22 | 19 | 53 |
| 49 | M | 1250 | 85 | 1010 | 920 | 91 | 500 | 24 | 18 | 53 |
| 50 | M | 1250 | 85 | 1010 | 920 | 91 | 500 | 24 | 18 | 53 |
| 51 | N | 1230 | 85 | 1010 | 940 | 91 | 600 | 22 | 15 | 53 |
| 52 | N | 1230 | 85 | 1010 | 940 | 91 | 600 | 22 | 15 | 53 |
| 53 | O | 1210 | 85 | 1030 | 920 | 91 | 510 | 26 | 14 | 53 |
| 54 | O | 1210 | 85 | 1030 | 920 | 91 | 510 | 26 | 14 | 53 |
| 55 | P | 1200 | 85 | 1010 | 940 | 91 | 620 | 25 | 14 | 53 |
| 56 | P | 1200 | 85 | 1010 | 940 | 91 | 620 | 25 | 14 | 53 |
| 57 | Q | 1260 | 85 | 1010 | 950 | 91 | 520 | 23 | 19 | 53 |
| 58 | R | 1240 | 85 | 990 | 930 | 91 | 620 | 25 | 19 | 53 |
| 59 | S | 1270 | 85 | 1050 | 940 | 91 | 600 | 28 | 14 | 53 |
| 60 | T | 1240 | 85 | 980 | 920 | 91 | 560 | 27 | 16 | 53 |
| 61 | U | 1250 | 85 | 1000 | 940 | 91 | 520 | 25 | 16 | 53 |
| 62 | V | 1240 | 85 | 1000 | 910 | 91 | 520 | 22 | 16 | 53 |

| | Hot dip galvanization step | | | | | | | | | | | | | | | |
|---|---|---|---|---|---|---|---|---|---|---|---|---|---|---|---|---|
| | Heating | | | | | | | | | | | | | | | |
| | Heating rate 650° C.-max. | | | First soaking | | First cooling | Second soaking | | | | | Second cooling Cooling | Third soaking | | | Ms in hot dip |
| No. | heating temp. ° C./s | log ($PH_2O/PH_2$) | $PH_2$ | Temp. ° C. | Holding time s | Cooling rate ° C./s | Temp. ° C. | Holding time s | log ($PH_2O/PH_2$) | $PH_2$ | Alloying Alloying temp. ° C. | stop temp. ° C. | Temp. ° C. | Holding time s | | galvanization step ° C. |
| 1 | 1.6 | −0.78 | 0.045 | 810 | 90 | 39 | 450 | 105 | −1.70 | 0.017 | 480 | 200 | 370 | 330 | | 289 |
| 2 | 2.0 | −0.75 | 0.050 | 820 | 90 | 50 | 330 | 105 | −1.70 | 0.015 | 470 | 190 | 380 | 330 | | 338 |
| 3 | 1.6 | −1.02 | 0.055 | 820 | 90 | 42 | 480 | 105 | −1.70 | 0.016 | 480 | 190 | 380 | 330 | | 335 |
| 4 | 1.8 | −0.68 | 0.049 | 810 | 90 | 39 | 470 | 105 | **-0.70** | 0.017 | 490 | 170 | 380 | 330 | | 307 |
| 5 | 1.8 | **-1.30** | 0.051 | 820 | 90 | 40 | 460 | 105 | −1.70 | 0.020 | 470 | 160 | 390 | 330 | | 334 |
| 6 | 1.7 | −0.74 | 0.048 | 810 | 90 | 35 | 400 | 470 | −1.70 | 0.008 | 480 | 60 | 390 | 330 | | 143 |
| 7 | 1.7 | −0.75 | 0.057 | 810 | 90 | 37 | 450 | 105 | −1.90 | 0.008 | 480 | **300** | 390 | 330 | | 289 |
| 8 | 1.8 | −0.81 | 0.053 | 810 | 90 | 42 | 450 | 105 | −1.70 | 0.015 | 480 | 170 | **190** | 330 | | 276 |
| 9 | 1.9 | −0.70 | 0.050 | 810 | 90 | 39 | 460 | 105 | −1.80 | 0.018 | — | 180 | 380 | 330 | | 288 |
| 10 | 1.8 | −0.66 | 0.051 | 860 | 90 | 32 | 530 | 105 | −1.90 | 0.013 | 480 | 220 | 380 | 330 | | 329 |
| 11 | 2.4 | −0.71 | 0.050 | 920 | 90 | 59 | 540 | 105 | −1.80 | 0.015 | 480 | 240 | 400 | 330 | | 397 |
| 12 | 1.8 | −0.30 | 0.047 | 880 | 90 | 38 | 540 | 105 | −1.80 | 0.017 | 480 | 210 | 390 | 330 | | 378 |
| 13 | 1.9 | −0.80 | 0.049 | 900 | 90 | 44 | 540 | 105 | −1.80 | 0.014 | 480 | 220 | 390 | 330 | | 392 |
| 14 | 1.8 | −0.75 | 0.054 | **750** | 90 | 30 | 540 | 105 | −1.80 | 0.018 | 480 | **100** | 390 | 330 | | <50 |
| 15 | 1.9 | −0.83 | 0.058 | 870 | 90 | **3** | 550 | 105 | −1.80 | 0.020 | 480 | 150 | 400 | 330 | | 222 |
| 16 | 1.8 | −0.70 | 0.050 | 860 | 90 | 32 | 550 | 105 | −1.90 | 0.013 | — | 220 | 380 | 330 | | 331 |
| 17 | 1.9 | −0.75 | 0.048 | 900 | 90 | 36 | 460 | 105 | −1.70 | 0.017 | 490 | 220 | 380 | 330 | | 324 |
| 18 | 1.9 | −0.74 | 0.049 | 900 | 90 | 35 | 420 | **650** | −1.70 | 0.016 | 460 | **50** | 400 | 330 | | <50 |
| 19 | 1.9 | −0.71 | 0.050 | 900 | 90 | 43 | 500 | 105 | −1.70 | 0.017 | — | 230 | 380 | 330 | | 340 |
| 20 | 2.2 | −0.85 | 0.055 | 880 | 90 | 33 | 490 | 105 | −1.80 | 0.015 | 480 | 250 | 360 | 330 | | 403 |

TABLE 2-continued

| | | | | | | | | | | | | | | | |
|---|---|---|---|---|---|---|---|---|---|---|---|---|---|---|---|
| 21 | 1.7 | −0.74 | 0.053 | 860 | 90 | 30 | 490 | 105 | −1.70 | 0.018 | 480 | 260 | 360 | 110 | 394 |
| 22 | 2.2 | −0.79 | 0.051 | 870 | 90 | 35 | **650** | 105 | −1.70 | 0.019 | 480 | 200 | 350 | 330 | 298 |
| 23 | 1.8 | −0.76 | 0.048 | 870 | 90 | 50 | **240** | 105 | −1.90 | 0.022 | 480 | 220 | 360 | 330 | 391 |
| 24 | 1.8 | −0.85 | 0.043 | 850 | 90 | 38 | 550 | 105 | −1.80 | 0.013 | 480 | 230 | 390 | 330 | 363 |
| 25 | 2.0 | −1.03 | 0.105 | 880 | 90 | 45 | 550 | 105 | −1.90 | 0.046 | 550 | 250 | 400 | 330 | 363 |
| 26 | 1.8 | −0.76 | 0.046 | 840 | 90 | 35 | 550 | 105 | −1.80 | 0.020 | 500 | 220 | 300 | 330 | 363 |
| 27 | 1.5 | −1.03 | 0.105 | 850 | 90 | 41 | 550 | 105 | −1.90 | 0.046 | 550 | **360** | 390 | 330 | 352 |
| 28 | 1.8 | −0.80 | 0.047 | 870 | 90 | 40 | 550 | **60** | −1.80 | 0.018 | 490 | 240 | 400 | 330 | 368 |
| 29 | 1.9 | −0.73 | 0.052 | 860 | 90 | 46 | 550 | 105 | −1.80 | 0.016 | 490 | 240 | 390 | **3** | 353 |
| 30 | 1.8 | −1.07 | 0.066 | 860 | 90 | 40 | 550 | 105 | −1.80 | 0.018 | — | 230 | 400 | 330 | 367 |
| 31 | 2.1 | −0.82 | 0.042 | 850 | 90 | 34 | 550 | 105 | −1.80 | 0.015 | 500 | 230 | 400 | 330 | 358 |
| 32 | 1.8 | −0.79 | 0.046 | 850 | 90 | 39 | 540 | 105 | −1.80 | 0.016 | 520 | 250 | 400 | 330 | 356 |
| 33 | 2.1 | **-0.05** | 0.028 | 850 | 90 | 40 | 550 | 105 | −1.70 | 0.017 | 550 | 230 | 400 | 330 | 357 |
| 34 | 2.2 | −0.56 | **0.003** | 850 | 90 | 40 | 550 | 105 | −1.80 | 0.016 | 540 | 230 | 400 | 330 | 356 |
| 35 | 1.8 | −0.80 | 0.056 | 850 | 90 | 43 | 550 | 105 | −1.40 | **0.0005** | 540 | 230 | 400 | 330 | 356 |
| 36 | 2.1 | −0.80 | 0.043 | 850 | 90 | 36 | 550 | 105 | −1.80 | 0.017 | — | 230 | 400 | 330 | 358 |
| 37 | 1.6 | −0.70 | 0.044 | 840 | 90 | 34 | 550 | 105 | −1.90 | 0.016 | 500 | 230 | 400 | 330 | 348 |
| 38 | 1.6 | −0.77 | 0.041 | 840 | 90 | 38 | 550 | 105 | −1.90 | 0.016 | — | 220 | 400 | 330 | 348 |
| 39 | 2.0 | −0.72 | 0.055 | 870 | 90 | 29 | 550 | 105 | −1.60 | 0.015 | 500 | 200 | 400 | 330 | 332 |
| 40 | 1.7 | −0.69 | 0.042 | 870 | 90 | 33 | 550 | 105 | −1.70 | 0.018 | — | 220 | 390 | 330 | 332 |
| 41 | 1.8 | −0.84 | 0.056 | 870 | 90 | 39 | 550 | 105 | −1.90 | 0.014 | 510 | 210 | 360 | 330 | 340 |
| 42 | 1.9 | −0.73 | 0.061 | 870 | 90 | 42 | 550 | 105 | −1.80 | 0.022 | — | 200 | 360 | 330 | 340 |
| 43 | 1.6 | −0.86 | 0.045 | 880 | 90 | 37 | 550 | 105 | −1.90 | 0.017 | 500 | 200 | 370 | 330 | 334 |
| 44 | 1.7 | −0.88 | 0.049 | 880 | 90 | 42 | 550 | 105 | −1.90 | 0.018 | — | 190 | 380 | 330 | 337 |
| 45 | 1.6 | −0.76 | 0.057 | 830 | 90 | 40 | 550 | 105 | −1.80 | 0.016 | 520 | 80 | 300 | 20 | 413 |
| 46 | 1.6 | −0.76 | 0.057 | 830 | 90 | 40 | 550 | 105 | −1.80 | 0.016 | — | 80 | 300 | 20 | 413 |
| 47 | 1.6 | −0.75 | 0.046 | 810 | 90 | 29 | 550 | 105 | −1.90 | 0.014 | 530 | 90 | 290 | 20 | 410 |
| 48 | 1.6 | −0.75 | 0.046 | 810 | 90 | 29 | 550 | 105 | −1.90 | 0.014 | — | 90 | 290 | 20 | 409 |
| 49 | 1.8 | −0.82 | 0.047 | 830 | 90 | 33 | 550 | 105 | −1.50 | 0.017 | 520 | 70 | 270 | 20 | 389 |
| 50 | 1.8 | −0.82 | 0.047 | 830 | 90 | 33 | 550 | 105 | −1.50 | 0.017 | — | 70 | 270 | 20 | 389 |
| 51 | 1.3 | −0.82 | 0.051 | 810 | 90 | 37 | 550 | 105 | −1.80 | 0.013 | 540 | 50 | 300 | 20 | 397 |
| 52 | 1.3 | −0.82 | 0.051 | 810 | 90 | 37 | 550 | 105 | −1.80 | 0.013 | — | 50 | 300 | 20 | 397 |
| 53 | 1.9 | −0.79 | 0.057 | 850 | 90 | 38 | 550 | 105 | −1.80 | 0.014 | 510 | 100 | 290 | 20 | 377 |
| 54 | 1.9 | −0.79 | 0.057 | 850 | 90 | 38 | 550 | 105 | −1.80 | 0.014 | — | 100 | 290 | 20 | 377 |
| 55 | 1.6 | −0.71 | 0.057 | 860 | 90 | 25 | 550 | 105 | −1.90 | 0.015 | 530 | 90 | 280 | 20 | 368 |
| 56 | 1.6 | −0.71 | 0.057 | 860 | 90 | 25 | 550 | 105 | −1.90 | 0.015 | — | 90 | 280 | 20 | 368 |
| 57 | 2.0 | −0.94 | 0.053 | 870 | 90 | 39 | 530 | 105 | −1.90 | 0.017 | 500 | 150 | 390 | 330 | <50 |
| 58 | 1.4 | −1.00 | 0.053 | 880 | 90 | 40 | 550 | 105 | −1.90 | 0.014 | 500 | 150 | 400 | 330 | <50 |
| 59 | 1.8 | −0.87 | 0.057 | 820 | 90 | 39 | 550 | 105 | −1.50 | 0.014 | 520 | 200 | 360 | 330 | 327 |
| 60 | 1.3 | −0.88 | 0.045 | 900 | 90 | 31 | 550 | 105 | −1.90 | 0.013 | 570 | 250 | 370 | 330 | 386 |
| 61 | 1.5 | −0.99 | 0.046 | 840 | 90 | 33 | 550 | 105 | −1.80 | 0.015 | 520 | 200 | 390 | 330 | 315 |
| 62 | 2.0 | −0.87 | 0.043 | 900 | 90 | 34 | 550 | 105 | −1.70 | 0.015 | 520 | 200 | 400 | 330 | 279 |

Bold underlines indicate outside scope of present invention.

A JIS No. 5 tensile test piece was taken from each of the thus obtained steel sheets in a direction perpendicular to the rolling direction and was subjected to a tensile test based on JIS Z2241: 2011 to measure the tensile strength (TS) and total elongation (El). Further, each test piece was tested by the "JFS T 1001 Hole Expansion Test Method" of the Japan Iron and Steel Federation Standards to measure the hole expansion rate (λ). A test piece with a TS of 980 MPa or more, a $TS \times El \times \lambda^{0.5}/1000$ of 80 or more, and passing the following bending test was judged good in mechanical properties and as having press formability preferable for use as a member for automobiles.

Further, a bending test was performed by the method prescribed in the Verband der Automobilindustrie (VDA) standard 238-100 to measure the maximum bending angle. A test piece with a tensile strength of less than 1180 MPa which had a bending angle of 90 degrees or more, one with a tensile strength of 1180 MPa or more and less than 1470 MPa which had a bending angle of 80 degrees or more, and one with over 1470 which had a bending angle of 70 degrees or more were judged as good in bendability and were evaluated as passing (in Table 3, "very good").

Further, a top hat shaped member having a closed cross-sectional shape such as shown in FIG. 2 was prepared and subjected to a stationary three-point bending test. The maximum load at that time was measured. A test piece with a value of the maximum load [kN] divided by the tensile strength [MPa] of 0.015 or more was judged as sufficiently suppressed in drop in load at the time of bending deformation and was evaluated as passing (in Table 3, "very good").

The results are shown in Table 3. In Table 3, "GA" means hot dip galvannealing, while GI means hot dip galvanizing without alloying treatment.

TABLE 3

| | | | Microstructure | | | | | | | | Mechanical properties | | | | | | | |
|---|---|---|---|---|---|---|---|---|---|---|---|---|---|---|---|---|---|---|
| | | | | | | | | | | Increase rate in thickness direction of | | Press formability | | | | | 3-point | |
| No. | Steel type | Coating | Ferrite % | Retained austenite % | Tempered martensite % | Fresh martensite % | Pearlite + cementite % | Bainite % | Soft layer thickness μm | tempered martensite %/μm | TS MPa | El % | λ % | TS*El *$\lambda^{0.5}$/1000 | Bendability | Noncoating | bending test max.; load/TS | Remarks |
| 1 | A | GA | 34 | 12 | 18 | 3 | 0 | 33 | 35 | 0.8 | 1010 | 23.8 | 33 | 138 | Very good | None | Very good | Ex. |
| 2 | A | GA | 25 | 11 | 30 | 2 | 0 | 32 | 33 | 1.5 | 1046 | 23.2 | 40 | 153 | Very good | None | Very good | Ex. |
| 3 | A | GA | 25 | 10 | 34 | 2 | 0 | 29 | 18 | 2.6 | 1077 | 20.5 | 46 | 150 | Very good | None | Very good | Ex. |
| 4 | A | GA | 32 | 12 | 25 | 2 | 0 | 29 | 45 | **7.8** | 1023 | 22.9 | 35 | 139 | Very good | None | Poor | Comp. ex. |
| 5 | A | GA | 26 | 11 | 37 | 2 | 0 | 24 | **0** | — | 1028 | 21.8 | 42 | 145 | Poor | None | Very good | Comp. ex. |
| 6 | A | GA | 33 | 12 | 7 | 1 | 0 | 47 | 30 | 0.3 | 984 | 23.4 | 30 | 126 | Very good | None | Very good | Ex. |
| 7 | A | GA | 35 | 11 | **0** | 5 | 0 | 49 | 33 | — | **958** | 21.5 | 18 | 87 | Very good | None | Poor | Comp. ex. |
| 8 | A | GA | 35 | 4 | 15 | **15** | 0 | 31 | 33 | 0.3 | 1125 | 18.0 | 14 | **76** | Poor | None | Very good | Comp. ex. |
| 9 | A | GI | 30 | 12 | 16 | 3 | 0 | 39 | 37 | 0.7 | 1012 | 24.0 | 31 | 135 | Very good | None | Very good | Ex. |
| 10 | B | GA | 40 | 11 | 21 | 1 | 0 | 27 | 40 | 1.0 | 994 | 25.0 | 29 | 134 | Very good | None | Very good | Ex. |
| 11 | B | GA | 6 | 12 | 56 | 2 | 0 | 24 | 48 | 1.7 | 1109 | 17.8 | 54 | 145 | Very good | None | Very good | Ex. |
| 12 | B | GA | 23 | 10 | 52 | 1 | 0 | 14 | 102 | 0.7 | 992 | 21.1 | 30 | 115 | Very good | None | Very good | Ex. |
| 13 | B | GA | 13 | 9 | 60 | 2 | 0 | 16 | 41 | **7.5** | 1058 | 18.5 | 51 | 140 | Very good | None | Poor | Comp. ex. |
| 14 | B | GA | **78** | 5 | **0** | 8 | 0 | 9 | 35 | — | **811** | 22.3 | 28 | 96 | Very good | None | Poor | Comp. ex. |
| 15 | B | GA | **65** | 4 | 10 | 4 | **6** | 11 | 38 | 0.2 | **913** | 19.6 | 19 | **78** | Very good | None | Very good | Comp. ex. |
| 16 | B | GI | 40 | 11 | 23 | 1 | 0 | 25 | 40 | 0.9 | 1006 | 24.8 | 30 | 137 | Very good | None | Very good | Ex. |
| 17 | C | GA | 49 | 10 | 25 | 3 | 0 | 13 | 42 | 0.9 | 984 | 22.5 | 20 | 99 | Very good | None | Very good | Ex. |
| 18 | C | GA | 50 | 11 | **0** | 3 | 0 | 36 | 45 | — | **937** | 20.5 | 21 | 88 | Very good | None | Very good | Comp. ex. |
| 19 | C | GI | 41 | 11 | 27 | 2 | 0 | 19 | 40 | 1.2 | 997 | 22.1 | 20 | 99 | Very good | None | Very good | Ex. |
| 20 | D | GA | 20 | 7 | 48 | 1 | 0 | 24 | 31 | 2.8 | 1056 | 17.7 | 45 | 125 | Very good | None | Very good | Ex. |
| 21 | D | GA | 28 | 6 | 39 | 3 | 0 | 24 | 33 | 1.6 | 1071 | 18.9 | 41 | 130 | Very good | None | Very good | Ex. |
| 22 | D | GA | **68** | 7 | 12 | 2 | **6** | 5 | 28 | 0.6 | **934** | 18.2 | 20 | **76** | Very good | None | Very good | Comp. ex. |
| 23 | D | GA | 27 | 7 | 43 | 1 | **0** | 22 | 30 | **7.4** | 982 | 17.0 | 41 | 107 | Very good | None | Poor | Comp. ex. |
| 24 | E | GA | 18 | 10 | 53 | 2 | 0 | 17 | 51 | 1.7 | 1236 | 16.3 | 48 | 140 | Very good | None | Very good | Ex. |
| 25 | E | GA | 16 | 11 | 45 | 1 | 0 | 27 | 15 | 4.2 | 1198 | 17.0 | 45 | 137 | Very good | None | Very good | Ex. |
| 26 | E | GA | 20 | 6 | 64 | 2 | 0 | 8 | 53 | 1.8 | 1312 | 13.8 | 35 | 107 | Very good | None | Very good | Ex. |
| 27 | E | GA | 19 | 7 | **0** | **18** | 0 | 56 | 47 | — | 1219 | 14.2 | 18 | **73** | Poor | None | Poor | Comp. ex. |
| 28 | E | GA | 15 | 11 | 51 | 2 | 0 | 21 | 50 | **6.6** | 1229 | 16.5 | 50 | 143 | Very good | None | Poor | Comp. ex. |
| 29 | E | GA | 18 | 4 | 47 | **17** | 0 | 14 | 55 | 1.2 | 1350 | 12.6 | 18 | **72** | Poor | None | Very good | Comp. ex. |
| 30 | E | GI | 14 | 10 | 55 | 2 | 0 | 19 | 52 | 1.5 | 1215 | 16.6 | 42 | 131 | Very good | None | Very good | Ex. |
| 31 | F | GA | 4 | 8 | 65 | 1 | 0 | 22 | 54 | 2.4 | 1229 | 14.4 | 50 | 125 | Very good | None | Very good | Ex. |
| 32 | F | GA | 4 | 8 | 51 | 2 | 0 | 35 | 55 | **7.3** | 1173 | 14.0 | 35 | 97 | Very good | None | Poor | Comp. ex. |
| 33 | F | GA | 4 | 8 | 59 | 1 | 0 | 28 | 137 | 0.6 | 1130 | 15.1 | 40 | 108 | Very good | **Yes** | Very good | Comp. ex. |
| 34 | F | GA | 5 | 8 | 55 | 1 | 0 | 31 | 89 | 1.1 | 1176 | 14.3 | 39 | 105 | Very good | **Yes** | Very good | Comp. ex. |
| 35 | F | GA | 4 | 8 | 56 | 2 | 0 | 30 | 57 | 1.6 | 1201 | 14.2 | 43 | 112 | Very good | **Yes** | Very good | Comp. ex. |
| 36 | F | GI | 4 | 8 | 64 | 1 | 0 | 23 | 50 | 2.4 | 1220 | 14.1 | 51 | 123 | Very good | None | Very good | Ex. |
| 37 | G | GA | 16 | 12 | 49 | 2 | 0 | 21 | 49 | 1.6 | 1215 | 17.8 | 41 | 138 | Very good | None | Very good | Ex. |
| 38 | G | GI | 16 | 11 | 51 | 1 | 0 | 21 | 55 | 2.0 | 1219 | 17.0 | 45 | 139 | Very good | None | Very good | Ex. |
| 39 | H | GA | 0 | 27 | 68 | 5 | 0 | 0 | 70 | 1.6 | 1529 | 17.7 | 25 | 135 | Very good | None | Very good | Ex. |

TABLE 3-continued

| | | | Microstructure | | | | | | | | Mechanical properties | | | | | | | |
|---|---|---|---|---|---|---|---|---|---|---|---|---|---|---|---|---|---|---|
| | | | | | | | | | | Increase rate in thickness direction of | | | | Press formability | | | 3-point | |
| No. | Steel type | Coating | Ferrite % | Retained austenite % | Tempered martensite % | Fresh martensite % | Pearlite + cementite % | Bainite % | Soft layer thickness μm | tempered martensite %/μm | TS MPa | El % | λ % | TS*El *$\lambda^{0.5}$/1000 | Bendability | Noncoating | bending test max.; load/TS | Remarks |
| 40 | H | GI | 0 | 28 | 65 | 7 | 0 | 0 | 75 | 1.9 | 1501 | 17.9 | 24 | 132 | Very good | None | Very good | Ex. |
| 41 | I | GA | 0 | 19 | 67 | 4 | 0 | 10 | 68 | 2.2 | 1493 | 15.1 | 30 | 123 | Very good | None | Very good | Ex. |
| 42 | I | GI | 0 | 18 | 69 | 3 | 0 | 10 | 70 | 1.5 | 1476 | 15.3 | 33 | 130 | Very good | None | Very good | Ex. |
| 43 | J | GA | 6 | 28 | 62 | 4 | 0 | 0 | 74 | 1.8 | 1521 | 16.9 | 28 | 136 | Very good | None | Very good | Ex. |
| 44 | J | GI | 4 | 25 | 68 | 3 | 0 | 0 | 70 | 1.6 | 1539 | 16.0 | 33 | 141 | Very good | None | Very good | Ex. |
| 45 | K | GA | 35 | 2 | 40 | 4 | 0 | 19 | 27 | 2.9 | 1012 | 13.6 | 51 | 98 | Very good | None | Very good | Ex. |
| 46 | K | GI | 35 | 2 | 38 | 4 | 0 | 21 | 27 | 2.7 | 1009 | 13.8 | 50 | 98 | Very good | None | Very good | Ex. |
| 47 | L | GA | 28 | 0 | 51 | 3 | 0 | 18 | 29 | 2.9 | 994 | 12.7 | 60 | 98 | Very good | None | Very good | Ex. |
| 48 | L | GI | 28 | 0 | 50 | 3 | 0 | 19 | 30 | 3.3 | 992 | 12.5 | 62 | 98 | Very good | None | Very good | Ex. |
| 49 | M | GA | 14 | 1 | 53 | 5 | 0 | 27 | 36 | 2.1 | 1245 | 11.0 | 50 | 97 | Very good | None | Very good | Ex. |
| 50 | M | GI | 14 | 1 | 54 | 5 | 0 | 26 | 37 | 2.9 | 1222 | 11.2 | 52 | 99 | Very good | None | Very good | Ex. |
| 51 | N | GA | 15 | 0 | 65 | 4 | 0 | 16 | 32 | 3.4 | 1211 | 10.5 | 58 | 97 | Very good | None | Very good | Ex. |
| 52 | N | GI | 15 | 0 | 63 | 4 | 0 | 18 | 33 | 2.8 | 1205 | 10.5 | 54 | 93 | Very good | None | Very good | Ex. |
| 53 | O | GA | 0 | 3 | 93 | 4 | 0 | 0 | 45 | 4.3 | 1542 | 7.9 | 57 | 92 | Very good | None | Very good | Ex. |
| 54 | O | GI | 0 | 3 | 93 | 4 | 0 | 0 | 46 | 4.6 | 1537 | 8.2 | 49 | 88 | Very good | None | Very good | Ex. |
| 55 | P | GA | 0 | 4 | 90 | 6 | 0 | 0 | 52 | 3.3 | 1536 | 9.1 | 44 | 93 | Very good | None | Very good | Ex. |
| 56 | P | GI | 0 | 4 | 90 | 6 | 0 | 0 | 55 | 2.8 | 1529 | 8.9 | 46 | 92 | Very good | None | Very good | Ex. |
| 57 | Q | GA | 40 | 1 | 0 | 0 | 0 | 59 | 12 | — | 796 | 24.7 | 26 | 147 | Very good | None | Very good | Comp. ex. |
| 58 | R | GA | **56** | 8 | 0 | 0 | 0 | 36 | 15 | — | 752 | 25.6 | 41 | 123 | Very good | None | Very good | Comp. ex. |
| 59 | S | GA | 12 | 4 | 65 | **12** | 0 | 7 | 41 | 2.9 | 1396 | 10.8 | 12 | **52** | Very good | None | **Brittle fracture** | Comp. ex. |
| 60 | T | GA | 10 | 6 | 57 | **15** | 0 | 12 | 58 | 2.0 | 1313 | 11.2 | 9 | **44** | Very good | None | **Brittle fracture** | Comp. ex. |
| 61 | U | GA | 0 | **31** | 40 | 8 | 0 | 21 | 65 | 1.1 | 1410 | 22.8 | 12 | 111 | Very good | None | **Brittle fracture** | Comp. ex. |
| 62 | V | GA | **55** | 10 | 13 | 4 | 0 | 18 | 44 | 0.4 | 940 | 25.7 | 20 | 108 | Very good | None | Very good | Comp. ex. |

Bold underlines indicate outside scope of present invention.

Comparative Example 4 had an atmosphere in the furnace at the time of the second soaking treatment in the hot dip galvanization step not satisfying formula (4). As a result, the desired surface layer structures could not be obtained and the maximum load at the time of the three-point bending test was poor. Comparative Example 5 had an atmosphere at the time of heating in the hot dip galvanization step not satisfying formula (2). As a result, a soft layer was not formed and the bendability was poor. Comparative Example 7 had a stop temperature of the second cooling in the hot dip galvanization step of more than Ms-50° C. As a result, tempered martensite could not be obtained and the tensile strength was a not satisfactory 980 MPa. Further, the maximum load at the time of the three-point bending test was also poor. Comparative Example 8 had a temperature of the third soaking treatment at the hot dip galvanization step of less than 200° C. As a result, the desired metallic structure could not be obtained and the press formability was poor. Comparative Example 13 had an A/B in the cold rolling step (rolling line load/tensile strength) of less than 13. Further, Comparative Example 32 had a rolling reduction in the cold rolling step of less than 6%. As a result, the increase rate in the thickness direction of the area % of tempered martensite in the surface layer structures became more than 5.0%/μm and the maximum load at the time of the three-point bending test was poor. Comparative Example 14 had a temperature of the first soaking treatment in the hot dip galvanization step of less than Ac1° C.+30° C. and a stop temperature of the second cooling of more than Ms-50° C. As a result, the desired metallic structure could not be obtained and the press formability and maximum load at the time of the three-point bending test were poor. Comparative Example 15 had an average cooling rate in the first cooling of less than 10° C./s. As a result, the ferrite was more than 50%, furthermore, the total of the pearlite and cementite became more than 5%, and the press formability was poor.

Comparative Example 18 had a holding time of the second soaking treatment of more than 500 seconds and had a stop temperature of the second cooling of more than Ms-50° C. As a result, the desired metallic structure could not be obtained and the press formability was poor. Comparative Example 22 had a temperature of the second soaking treatment of more than 600° C. As a result, the ferrite was more than 50%, the total of the pearlite and cementite was more than 5%, and the press formability was poor. Comparative Example 23 had a temperature of the second soaking treatment in the hot dip galvanization step of less than 300° C. As a result, the desired surface layer structures could not be obtained and the maximum load at the time of the three-point bending test was poor. Comparative Example 27 had a stop temperature of the second cooling in the hot dip galvanization step of more than Ms-50° C. As a result the desired metallic structure could not be obtained and the press formability and maximum load at the time of the three-point bending test were poor. Comparative Example 28 had a holding time of the second soaking treatment of less than 80 seconds. As a result, the increase rate in the thickness direction of the area % of tempered martensite in the surface layer structure became more than 5.0%/μm and the maximum load at the time of the three-point bending test was poor. Comparative Example 29 had a holding time in the third soaking treatment in the hot dip galvanization step of less than 5 seconds. As a result, the fresh martensite became more than 10% and the press formability was poor. Comparative Example 33 had an atmosphere at the time of heating in the hot dip galvanization step not satisfying the formula (2). Comparative Example 34 had a hydrogen partial pressure at the time of heating not satisfying the formula (3). Furthermore, Comparative Example 35 had a hydrogen partial pressure at the time of the second soaking treatment not satisfying the formula (5). As a result, in these comparative examples, noncoating appeared. In Comparative Examples 57 to 62, the chemical composition was not controlled to within predetermined ranges, so the desired metallic structure could not be obtained and the press formability was poor. Further, in Comparative Examples 59 to 61, the contents of C, Si, and Mn were excessive, so the steel sheets were insufficient in toughness and the test members brittle fractured during the three-point bending test.

In contrast to this, the hot dip galvanized steel sheets of the examples have a tensile strength of 980 MPa or more, a $TS \times El \times \lambda^{0.5}/1000$ of 80 or more, and good results in the three-point bending test, so it is learned that they are excellent in press formability and kept down in drop of load at the time of bending deformation. Further, the hot dip galvanized steel sheets of Examples 10, 24, 31, and 39 were investigated for hardness at the position of ¼ thickness to the base steel sheet side from the interface of the base steel sheet and hot dip galvanized layer, whereupon they were respectively 315 HV, 394 HV, 390 HV, and 487 HV.

The invention claimed is:

1. A hot dip galvanized steel sheet comprising a base steel sheet and a hot dip galvanized layer on at least one surface of the base steel sheet, wherein the base steel sheet has a chemical composition comprising, by mass %, C: 0.050% to 0.350%,
Si: 0.10% to 2.50%,
Mn: 1.00% to 3.50%,
P: 0.050% or less,
S: 0.0100% or less,
Al: 0.001% to 1.500%,
N: 0.0100% or less,
O: 0.0100% or less,
Ti: 0% to 0.200%,
B: 0% to 0.0100%,
V: 0% to 1.00%,
Nb: 0% to 0.100%,
Cr: 0% to 2.00%,
Ni: 0% to 1.00%,
Cu: 0% to 1.00%,
Co: 0% to 1.00%,
Mo: 0% to 1.00%,
W: 0% to 1.00%,
Sn: 0% to 1.00%,
Sb: 0% to 1.00%,
Ca: 0% to 0.0100%,
Mg: 0% to 0.0100%,
Ce: 0% to 0.0100%,
Zr: 0% to 0.0100%,
La: 0% to 0.0100%,
Hf: 0% to 0.0100%,
Bi: 0% to 0.0100%,
REM other than Ce and La: 0% to 0.0100% and
a balance of Fe and impurities, a steel microstructure at a range of ⅛ thickness to ⅜ thickness centered about a position of ¼ thickness from a surface of the base steel sheet contains, by area %, ferrite: 0% to 50%,
retained austenite: 0% to 30%,
tempered martensite: 5% or more,
fresh martensite: 0% to 10%, and
pearlite and cementite in total: 0% to 5%, when there are remaining structures, the remaining structures consist of bainite, when defining a region having a hardness of 90% or less of the hardness at a position of ¼ thickness to the base steel sheet side from an interface of the base steel sheet and the hot dip galvanized layer as a "soft layer", there is a soft layer having a thickness of 10 μm or more at the base steel sheet side from the interface, the soft layer contains tempered martensite, and an increase rate in a thickness direction of an area % of tempered martensite from the interface to the inside of the base steel sheet inside the soft layer is 5.0%/μm or less.

2. The hot dip galvanized steel sheet according to claim 1, wherein the steel microstructure further contains, by area %, retained austenite: 6% to 30%.

3. A method for producing the hot dip galvanized steel sheet according to claim 1, comprising:

a hot rolling step of hot rolling a slab having the chemical composition of the base steel sheet according to claim 1 to obtain a hot rolled steel sheet;

a cold rolling step of cold rolling the hot rolled steel sheet to obtain a cold rolled steel sheet; and a hot dip galvanizing step of hot dip galvanizing the cold rolled steel sheet to obtain the hot dip galvanized steel sheet;

wherein:

(A) the cold rolling step satisfies the conditions of the following (A1) and (A2):

(A1) a rolling line load satisfies the following formula (1) and cold rolling with a rolling reduction of 6% or more is performed one time or more:

$$13 \leq A/B \leq 35 \quad \text{formula (1)}$$

wherein in formula (1), A is the rolling line load in kgf/mm and B is the tensile strength of the hot rolled steel sheet in kgf/mm$^2$;

(A2) a total cold rolling reduction is 30 to 80%; and (B) the hot dip galvanizing step comprises: subjecting the cold rolled steel sheet to a first soaking treatment followed by a first cooling to obtain a first cooled steel sheet; subjecting the first cooled steel sheet to a second soaking treatment to obtain a second soaked steel sheet; dipping the second soaked steel sheet in a hot dip galvanizing bath to obtain a coated steel sheet; a second cooling of the coated steel sheet to obtain a second cooled steel sheet; and subjecting the second cooled steel sheet to a third soaking treatment; and wherein the hot dip galvanizing step further satisfies the following conditions (B1) to (B6):

(B1) in the first soaking treatment, the cold rolled steel sheet is heated to a maximum heating temperature in an atmosphere satisfying the following formulas (2) and (3), wherein the maximum heating temperature is at least Ac1+30° C. or more and 950° C. or less, and an average heating rate from 650° C. to the maximum heating temperature is 0.5° C./s to 10.0° C./s;

(B2) in the first soaking treatment, the cold rolled steel sheet which has been heated to the maximum heating temperature is held at the maximum heating temperature for 1 second to 1000 seconds;

(B3) in the first cooling, an average cooling rate in a temperature range of 700° C. to 600° C. is 10° C./s to 100° C./s;

(B4) in the second soaking treatment, the first cooled steel sheet is held in a range of 300° C. to 600° C. for 80 seconds to 500 seconds in an atmosphere satisfying the following formulas (4) and (5);

(B5) in the second cooling, cooling the coated steel sheet to a temperature of Ms-50° C. or less wherein Ms represents martensite transformation start temperature of the base steel sheet; and (B6) in the third soaking treatment, the second cooled steel sheet is heated to a temperature region of 200° C. to 420° C., then held in the temperature region for 5 seconds to 500 seconds;

$$-1.10 \leq \log(PH_2O/PH_2) \leq -0.07 \quad \text{formula (2)}$$

$$0.010 \leq PH_2 \leq 0.150 \quad \text{formula (3)}$$

$$\log(PH_2O/PH_2) < -1.10 \quad \text{formula (4)}$$

$$0.0010 \leq PH_2 \leq 0.1500 \quad \text{formula (5)}$$

wherein $PH_2O$ and $PH_2$ represent partial pressures of water vapor and hydrogen respectively of the respective atmosphere of the conditions (B1) and (B4).

* * * * *